US007949280B2

(12) United States Patent
Arimoto et al.

(10) Patent No.: US 7,949,280 B2
(45) Date of Patent: May 24, 2011

(54) IMAGE HEATING APPARATUS

(75) Inventors: Kota Arimoto, Abiko (JP); Taisuke Matsuura, Toride (JP); Ryo Hanashi, Moriya (JP); Jun Tomine, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/693,677

(22) Filed: Jan. 26, 2010

(65) Prior Publication Data

US 2010/0180785 A1 Jul. 22, 2010

Related U.S. Application Data

(60) Continuation of application No. 12/480,854, filed on Jun. 9, 2009, now Pat. No. 7,684,724, which is a division of application No. 11/470,022, filed on Sep. 5, 2006, now Pat. No. 7,561,818.

(30) Foreign Application Priority Data

Sep. 13, 2005 (JP) ..... 2005-265880

(51) Int. Cl.
*G03G 21/20* (2006.01)

(52) U.S. Cl. ..... 399/92; 399/33; 399/43; 399/67; 399/69; 399/94

(58) Field of Classification Search ..... 399/33, 399/43, 67, 69, 92, 94
See application file for complete search history.

(56) References Cited

U.S. PATENT DOCUMENTS 5,083,168 A 1/1992 Kusaka et al.
5,148,226 A 9/1992 Setoriyama et al.
5,149,941 A 9/1992 Hirabayashi et al.
5,162,634 A 11/1992 Kusaka et al.
5,210,579 A 5/1993 Setoriyama et al.
5,262,834 A 11/1993 Kusaka et al.
(Continued)

FOREIGN PATENT DOCUMENTS

JP 01-245268 9/1989
(Continued)

OTHER PUBLICATIONS

Japanese Office Action dated Nov. 30, 2010, in Japanese Application No. 2005-265880, and English-language translation thereof.

*Primary Examiner* — Ryan D Walsh

(74) *Attorney, Agent, or Firm* — Fitzpatrick, Cella, Harper & Scinto

(57) ABSTRACT

An image heating apparatus includes a heating rotary member, which heats an image on a recording material at a nip portion, an air blowing device for blowing air toward an air blowing port to cool a predetermined area of the heating rotary member, a shutter, which opens and closes the air blowing port, and a determination device. The determination device determines an execution of an operation of the air blowing device with the shutter opened after a first job is completed, in accordance with a size of a recording material in a width direction perpendicular to a recording material transport direction in a second job for supplying a recording material, between an execution termination of the first job for continuously supplying recording materials having a size smaller than a predetermined size in the width direction, while operating the air blowing device, and a start of a recording material supply of the second job, in a case that the second job is executed subsequent to the termination of the first job.

9 Claims, 20 Drawing Sheets

U.S. PATENT DOCUMENTS

| | | | |
|---|---|---|---|
| 5,300,997 | A | 4/1994 | Hirabayashi et al. |
| 5,343,280 | A | 8/1994 | Hirabayashi et al. |
| 5,525,775 | A | 6/1996 | Setoriyama et al. |
| 5,550,621 | A | 8/1996 | Ogawahara |
| 5,767,484 | A | 6/1998 | Hirabayashi et al. |
| 6,539,185 | B2 | 3/2003 | Hanyu et al. |
| 2001/0048822 | A1 | 12/2001 | Hanyu et al. |
| 2002/0141775 | A1 | 10/2002 | Mitsuoka et al. |
| 2003/0063931 | A1 | 4/2003 | Sanpei et al. |
| 2006/0140662 | A1 | 6/2006 | Nagase |
| 2007/0059012 | A1 | 3/2007 | Tomine et al. |
| 2007/0059021 | A1 | 3/2007 | Hanashi et al. |

FOREIGN PATENT DOCUMENTS

| | | |
|---|---|---|
| JP | 2-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 04-051179 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 5-119669 | 5/1993 |
| JP | 63-313182 | 12/1998 |
| JP | 2001-343857 | 12/2001 |
| JP | 2002-287564 | 10/2002 |
| JP | 2003-076209 | 3/2003 |
| JP | 2003-195669 | 7/2003 |
| JP | 2005-077792 | 3/2005 |

ELECTRIC POWER VALUE = (DETECTED TEMPERATURE - SET TEMPERATURE) × A

IMAGE HEATING APPARATUS

BACKGROUND OF THE INVENTION

1. Field of the Invention

The present invention relates to an image heating apparatus for heating an image formed on a recording material. Examples of the image heating apparatus include, for example, a fixing apparatus for fixing an unfixed image on the recording material, and a gloss improving apparatus for improving gloss of an image by heating an image fixed on the recording material. The image heating apparatus is used in an image forming apparatus such as a copying machine, a printer, a facsimile, and a composite machine having a plurality of functions thereof.

2. Description of the Related Art

Recently, regarding a fixing apparatus, energy-conservation is becoming active, and the reduction in a rising time is considered.

As one means, a belt fixing system has been proposed, in which a belt-shaped endless belt (hereinafter, referred to as a "fixing belt") is used as a heating rotary member, and toner on a recording material is heated via the belt heated by a heater.

A belt fixing apparatus is proposed, for example, by Japanese Patent Application Laid-open No S63-313182, Japanese Patent Application Laid-open No. H02-157878, Japanese Patent Application Laid-open No. H04-44075, and Japanese Patent Application Laid-open No. H04-204980.

In the belt fixing apparatus, a fixing belt is sandwiched between a ceramic heater serving as a heating member and a pressure roller serving as a pressure member, whereby a fixing area (i.e., fixing nip portion) is formed. A recording material on which an unfixed toner image is formed and carried is introduced between the fixing belt and the pressure roller in the fixing area, and the recording material is transported under the condition of being sandwiched therebetween together with the fixing belt. Consequently, the unfixed toner image is fixed onto the surface of the recording material with a pressure force of the fixing nip portion while the heat of a ceramic heater is given via the fixing belt.

Such a fixing apparatus uses a member with a low heat capacity for the fixing belt. Therefore, there is an advantage that the waiting time from the power-up of an image forming apparatus to a state where an image can be formed is short (i.e., quick start property), the power consumption during stand-by is remarkably small (i.e., low power consumption), etc.

In order to fix a recording material with a largest length in the width direction (hereinafter, referred to as a maximum-size recording material), for example, the entire area of an A4 landscape sheet (size: 297 mm), it is preferable to heat a portion in the width direction of the fixing belt to a temperature equal to or higher than that of a portion in the width direction of the maximum-size recording material. However, a recording material with a length in the width direction smaller than that of the maximum-size recording material (hereinafter, referred to as a small-size recording material), for example, an A4 portrait sheet (size: 210 mm) is continuously supplied, the temperature in a non-sheet passing area of the fixing belt rises excessively. Therefore, when a maximum-size recording material is supplied after the continuous sheet supply of a small-size recording material, hot-offset occurs in a portion of the small-size recording material corresponding to the non-sheet passing portion, which remarkably degrades image quality. Alternatively, when a small-size recording material (e.g., a B4 portrait sheet) with a length in the width direction larger than that of the small-size recording material (e.g., an A4 portrait sheet) that is continuously supplied, hot-offset occurs in a portion of the former recording material corresponding to the non-sheet passing portion, which remarkably degrades image quality.

In order to prevent a hot-offset phenomenon occurring along with the excessive increase in temperature of the non-sheet passing area of the fixing belt, in a conventional fixing apparatus, self-radiation cooling is allowed to be performed until the temperature of the non-sheet passing area of the fixing belt decreases sufficiently after the continuous sheet supply of small-size recording materials. Then, after the temperature distribution over the entire area in the width direction of the fixing belt becomes substantially uniform, maximum-size sheets or the like are supplied continuously.

However, in order to make the temperature distribution over the entire area in the width direction substantially uniform by self-radiation cooling, a cooling time of about several seconds to several minutes (hereinafter, referred to as a "downtime") is required. That is, the subsequent sheet cannot be supplied by the downtime, which prevents the enhancement of productivity.

SUMMARY OF THE INVENTION

An object of the present invention is to provide an image heating apparatus capable of reducing a time from the completion of previous image heating processing to the execution of subsequent image heating processing, while suppressing the occurrence of image heating defects.

Another object of the present invention is to provide an image heating apparatus, including:

a heating rotary member, which heats an image on a recording material in a nip portion;

air blowing means for blowing air toward an air blowing port to cool a predetermined area of the heating rotary member; and a shutter, which opens and closes the air blowing port, wherein a cooling operation can be performed continuously with the shutter opened after image heating processing is completed.

Further features of the present invention will become apparent from the following description of exemplary embodiments with reference to the attached drawings.

DESCRIPTION OF THE EMBODIMENTS

Hereinafter, the present invention will be described in detail by referring to embodiments. It should be noted that the embodiments are examples of best embodiment modes of the present invention. However, the present invention is not limited to a variety of constitutions described in the embodiments. In other words, the variety of constitutions described in the embodiments can be replaced with another well-known constitution within a scope of an idea of the present invention.

First Embodiment

(1) Image Forming Portion

Figure 3:
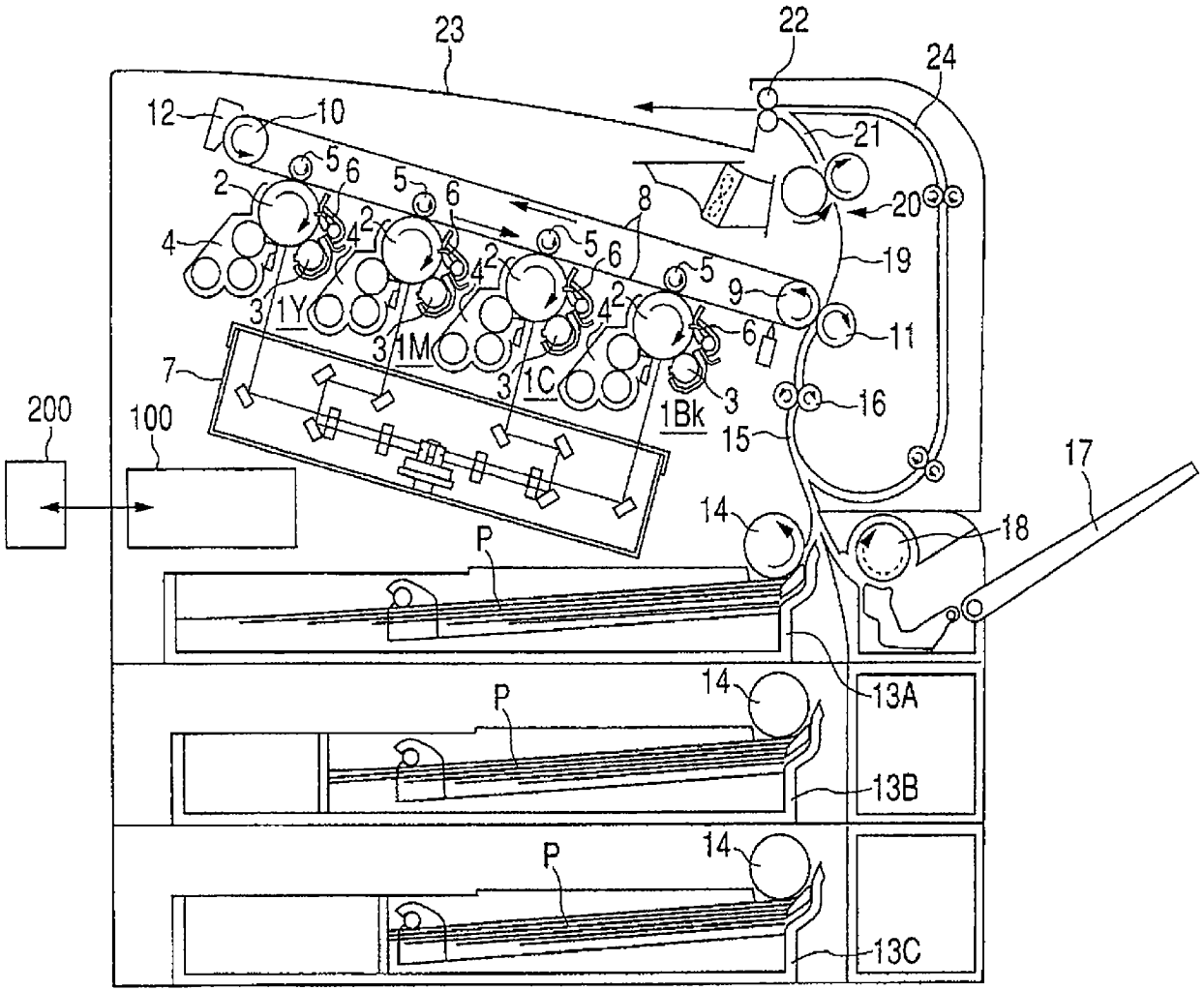
FIG. 3 is a longitudinal sectional view schematically showing an example of an image forming apparatus mounted with the fixing apparatus.

FIG. 3 is a longitudinal sectional view schematically showing a structure of an electrophotographic full-color printer which is an example of an image forming apparatus mounted with an image heating apparatus according to the present invention as a fixing apparatus. First, an outline of an image forming portion will be described.

This printer performs an image forming operation according to input image information from an external host device 200 connected to a control circuit portion (i.e., control substrate; CPU) 100 so as to communicate with each other, thereby making it possible to form a full-color image on a recording material and output the formed full-color image.

The external host device 200 is a computer, an image reader, or the like. The control circuit portion 100 transmits/receives a signal to/from the external host device 200. In addition, the control circuit portion 100 transmits/receives a signal to/from a variety of image forming devices and controls an image formation sequence.

An intermediate transfer belt (hereinafter, briefly referred to as "belt") 8, which is an endless flexible belt, is stretched around a secondary transferring opposing roller 9 and a tension roller 10. The intermediate transfer belt 8 is rotationally driven counterclockwise as indicated by the arrows at a predetermined speed by a drive of the secondary transferring opposing roller 9. A secondary transfer roller 11 is brought into pressure contact with the secondary transferring opposing roller 9 through the belt 8. An abutting portion between the belt 8 and the secondary transferring roller 11 is a secondary transferring portion.

A first image forming portion 1Y, a second image forming portion 1M, a third image forming portion 1C, and a fourth image forming portion 1Bk are arranged in line on a lower side of the belt 8 at predetermined intervals along a belt movement direction. Each of the image forming portions is an electrophotographic process mechanism of a laser exposure system, and has a drum-type electrophotographic photosensitive member (hereinafter, briefly referred to as "drum") 2 serving as an image bearing member which is rotationally driven clockwise as indicated by the arrow at a predetermined speed. On the periphery of each drum 2, a primary charger 3, a developing device 4, a transferring roller 5 serving as transferring means, and a drum cleaning device 6 are arranged. Each transferring roller 5 is arranged inside the belt 8, and is brought into pressure contact with the corresponding drum 2 through a descending side belt portion of the belt 8. An abutting portion between each drum 2 and the belt 8 is a primary transferring portion. A laser exposure device 7 opposing the drum 2 of each of the image forming portions is constituted of laser emitting means for emitting light corresponding to a time-series electric digital image signal of given image information, a polygon mirror, a reflecting mirror, and the like.

The control circuit portion 100 causes each of the image forming portions to perform an image formation operation based on a color separated image signal inputted from the external host device 200. As a result, in the first to fourth image forming portions 1Y, 1M, 1C, and 1Bk, color toner images for Yellow, Magenta, Cyan, and Black are formed on the respective surfaces of the rotating drums 2 at a predetermined control timing. It should be noted that the principle and process of the electrophotographic image formation in which toner images are formed on the drums 2 are well known, so the description thereof will be omitted.

The toner images formed on the respective surfaces of the drums 2 of the image forming portions are superimposed on top of each other to be sequentially transferred onto an outer surface of the belt 8 which is rotationally driven in a forward direction with respect to a rotation direction of each drum 2 at a speed corresponding to the rotation speed of each drum 2 in the primary transferring portion. As a result, four toner images formed on the surface of the belt 8 are superimposed on top of each other to be synthesized to form an unfixed full-color toner image.

Meanwhile, at a predetermined sheet feeding timing, a sheet feeding roller 14, which is provided on a feed cassette on a stage selected among vertical multi-stage cassette sheet feeding portions 13A, 13B, and 13C for stacking and containing recording materials P each having a variety of width sizes, is driven. As a result, the recording materials P stacked and contained in the sheet feed cassette on the stage are separately fed one by one through a vertical transport path 15, and are transported to registration rollers 16. When a manual sheet feeding is selected, a sheet feed roller 18 is driven. Thus, one sheet of the recording materials set to be stacked on a manual feed tray (i.e., multi-purpose tray) 17 is separately fed through the vertical transport path 15 to be transported to the registration rollers 16.

The registration rollers 16 transport the recording material P at a predetermined timing so that a leading edge of the recording material P reaches the secondary transferring portion at a timing when a leading end of the full-color toner image formed on the rotating belt 8 reaches the secondary transferring portion. As a result, in the secondary transferring portion, the full-color toner images formed on the belt 8 are collectively and sequentially secondarily-transferred on a surface of the recording material P. The recording material P, after passing the secondary transferring portion, is separated from the surface of the belt 8, is guided into a vertical guide 19, and is introduced into a fixing apparatus (i.e., fixing device) 20. By the fixing apparatus 20, the multiple-color toner images are fused to be mixed, and are fixed on the surface of the recording material as a permanent fixed image. The recording material P, which has passed the fixing apparatus 20, is fed onto a delivery tray 23 as a full-color image product by delivery rollers 22 through a transport path 21.

In the secondary transferring portion, the surface of the belt 8 after being separated from the recording material is cleaned by removing residual materials such as secondary transfer residual toner by a belt cleaning device 12, so the surface of the belt 8 can be repeatedly used for image formation.

In a monochrome printing mode, only the fourth image forming portion Bk for forming a black toner image is controlled to perform an image formation operation. When a two-side printing mode is selected, a recording material, a first surface of which has been printed, is fed onto the delivery tray 23 by the delivery rollers 22. At a time point immediately before a trailing edge of the recording material passes the delivery rollers 22, the rotation of the delivery rollers 22 is converted into a negative rotation. As a result, the recording material is switched back and is introduced into a re-transport path 24. Then, the surface of the recording material is turned over to be transported to the registration rollers 16 again. After that, in a similar manner as in the printing of the first surface, the recording material is transported to the secondary transferring portion and to the fixing apparatus 20, and is then fed onto the delivery tray 23 as a two-side printing image forming product.

(2) Fixing Apparatus 20

In the following description, in a fixing apparatus or a member constituting the fixing apparatus, a longitudinal direction (also referred to as width direction) indicates a direction parallel to a direction perpendicular to a recording material transport direction within a surface of a recording material transport path. As regards the fixing apparatus, a front surface thereof indicates a surface at a recording material introducing side, and left or right thereof indicates left or right when the apparatus is viewed from the front surface. A width of the recording material indicates a length of the recording material in a direction perpendicular to the recording material transport direction on the surface of the recording material.

Figure 2:
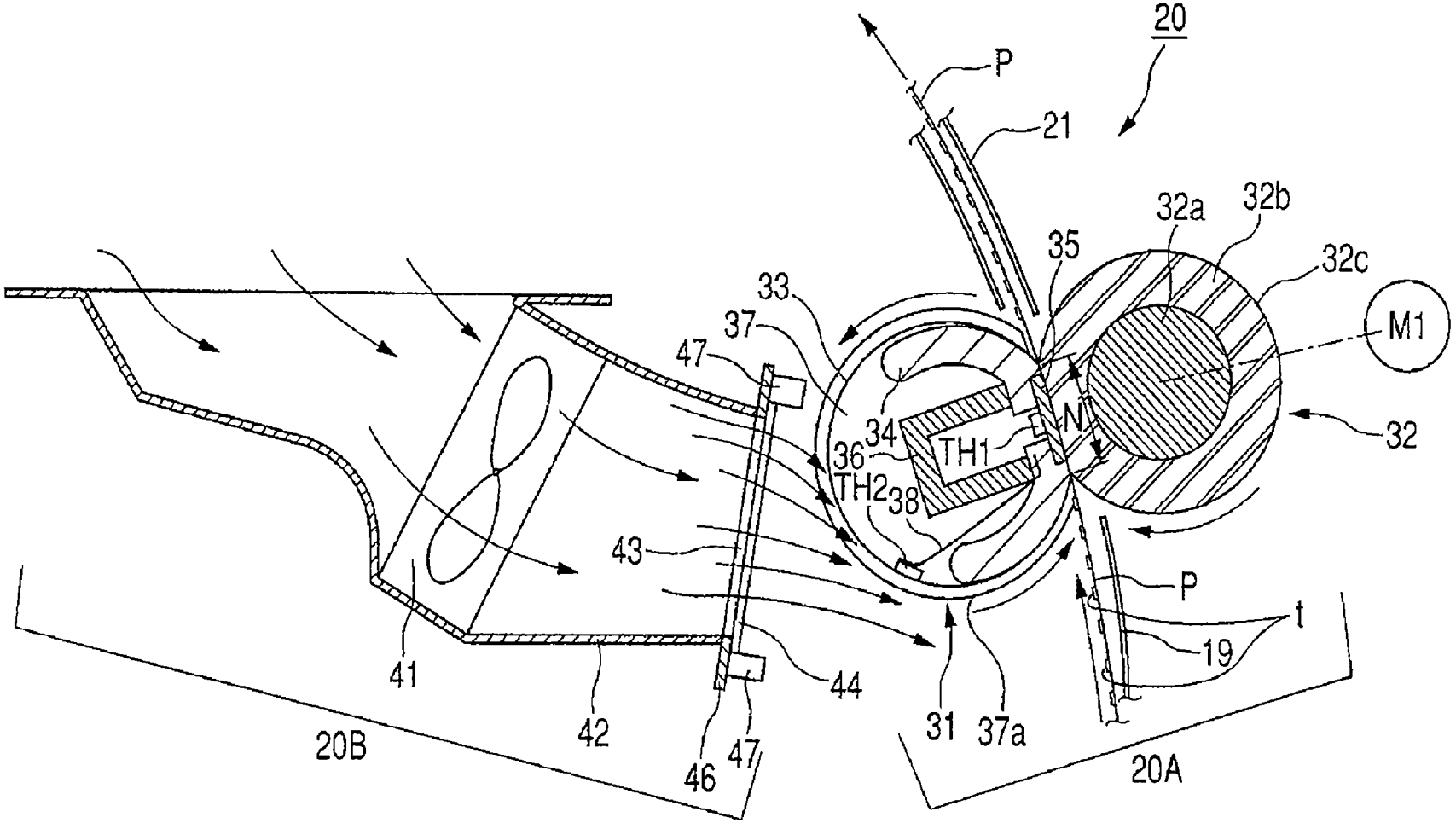
FIG. 2 is a horizontal cross-sectional view showing a schematic configuration of a fixing apparatus (i.e., image heating apparatus)
Figure 4:
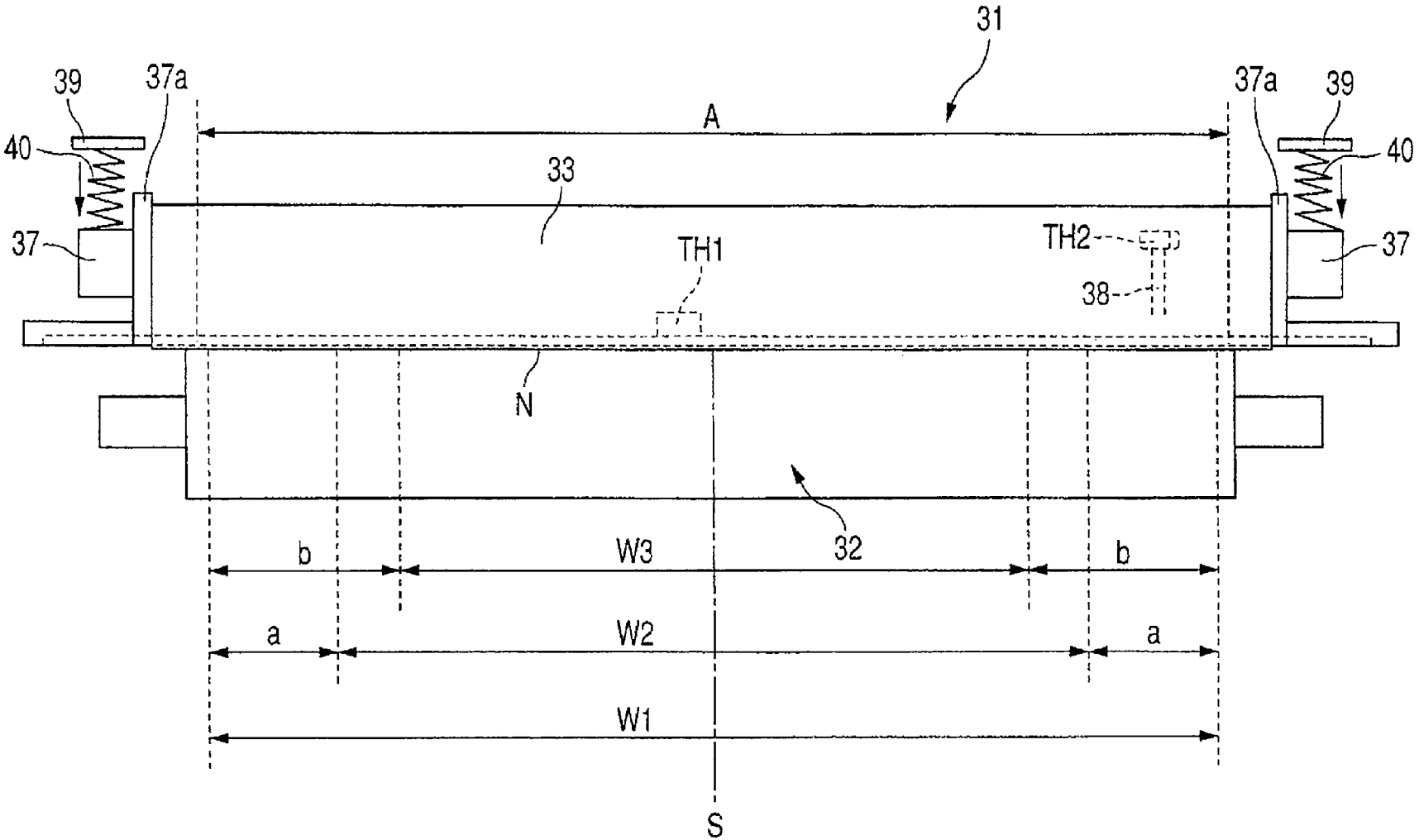
FIG. 4 is a schematic diagram showing a front surface of a fixing mechanism portion of the fixing apparatus.
Figure 5:
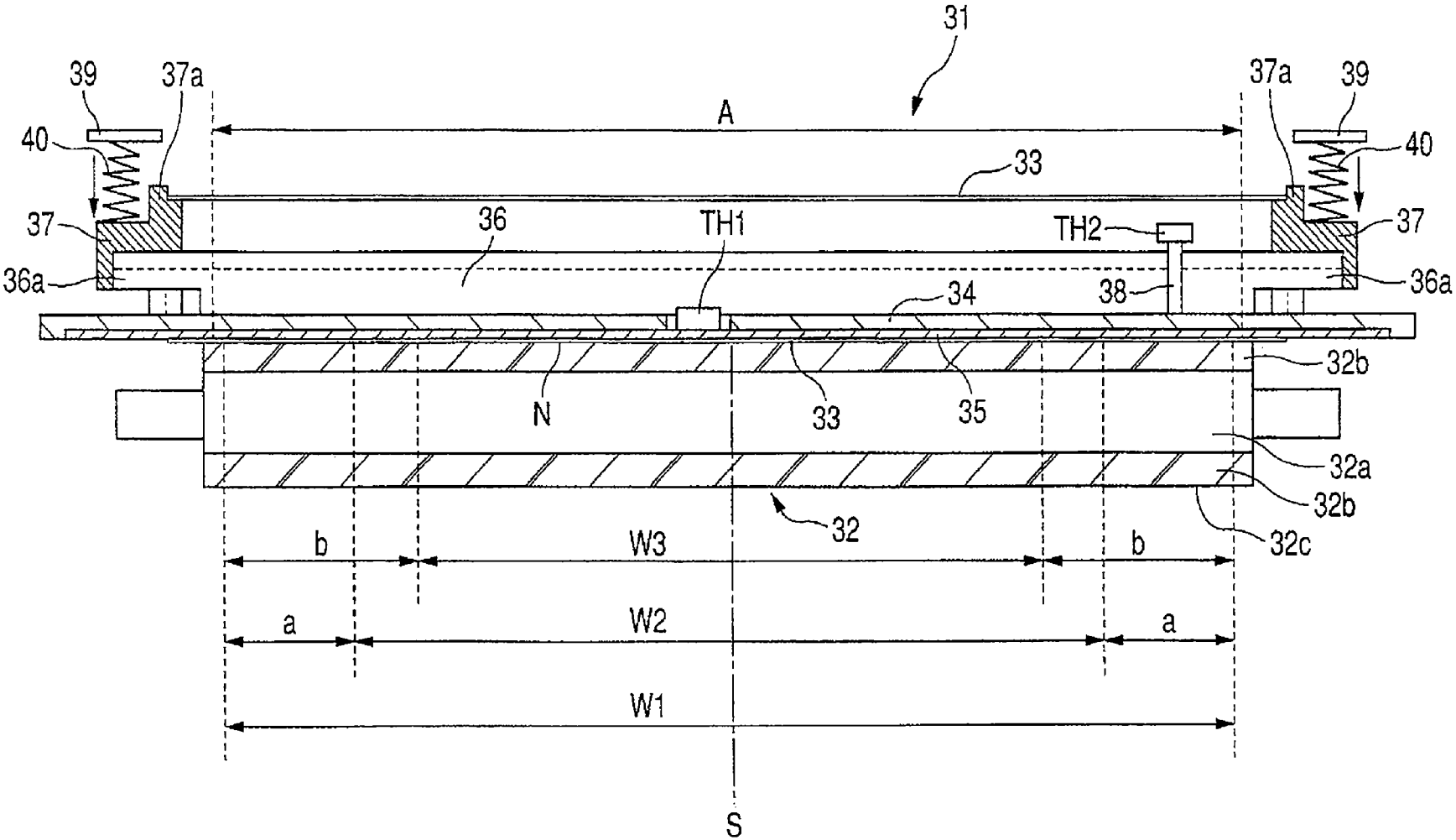
FIG. 5 is longitudinal sectional view schematically showing the front surface of the fixing mechanism portion.

FIG. 2 is a horizontal cross-sectional view schematically showing the structure of the fixing apparatus 20 serving as an image heating apparatus according to this embodiment. The fixing apparatus 20 is mainly composed of a belt (i.e., film) heating type fixing mechanism portion 20A and an air blowing/cooling mechanism portion 20B. FIG. 4 is a schematic diagram of a front surface of the fixing mechanism portion 20A, and FIG. 5 is a schematic longitudinal sectional view of the front surface of the fixing mechanism portion 20A.

(2-1) Fixing Mechanism Portion 20A

First, an outline of the fixing mechanism portion 20A will be described. The fixing mechanism portion 20A is basically a film heating type or pressure rotary member driving type (i.e., tensionless type) on-demand fixing apparatus, which is disclosed in Japanese Patent Application No. H04-44075 to Japanese Patent Application No. H04-44083, Japanese Patent Application No. H04-204980 to Japanese Patent Application No. H04-204984, and the like.

By contact pressures of a belt assembly 31 serving as a first fixing member (i.e., heating member) and an elastic pressure roller 32 serving as a second fixing member (i.e., pressure member), a fixing nip (i.e., sheet passing nip) portion N is formed.

The belt assembly 31 includes a cylindrical fixing belt having flexibility (i.e., a fixing film or a thin-walled roller; hereinafter, sometimes referred to simply as "belt") 33 serving as a heating rotary member, a heat-resistant and rigid belt guide member 34 (hereinafter, referred to simply as "guide member") having a semi-circular trough-shaped cross section, and a ceramic heater (hereinafter, referred to simply as "heater") 35 serving as a heating source. The ceramic heater 35 is fitted into a concave groove provided for the guide member 34 along the longitudinal direction to be fixed onto an outer surface of the guide member 34. The belt 33 is loosely fitted on the guide member 34, to which the heater 35 is attached. A rigid pressure stay (hereinafter, referred to simply as "stay") 36 having a U-shaped cross section is provided inside the guide member 34. An end holder 37 is fitted into each of external projecting arms 36*a* on the right and left ends of the stay 36 to be attached thereto. A flange 37*a* is integrally formed with the end holder 37.

The pressure roller 32 has a cored bar 32*a* provided with an elastic layer 32*b* made of silicone rubber or the like, thereby lowering hardness thereof. In order to improve a surface property, a fluororesin layer 32*c* made of PTFE, PFA, FEP, or the like may be provided. The pressure roller 32 serving as a pressure rotary member is arranged such that both end portions of the cored bar 32*a* are rotatably held by a bearing member between side plates provided at left and right of an apparatus chassis (not shown).

The heater 35 side of the belt assembly 31 is arranged to be opposed to the pressure roller 32 to thereby be in parallel to each other. A compression spring 40 is compressed between the left and right end portion holders 37 and left and right fixed spring receiving members 39. As a result, the stay 36, the guide member 34, and the heater 35 are pressed and urged against the pressure roller 32 side. The pressing/urging force is set at a predetermined level, and the heater 35 is brought into pressure contact with the pressure roller 32 against the elasticity of the elastic layer 32*b* through the belt 33, thereby forming the fixing nip portion N having a predetermined width between the belt 33 and the pressure roller 32 in the recording material transport direction.

Figure 6:
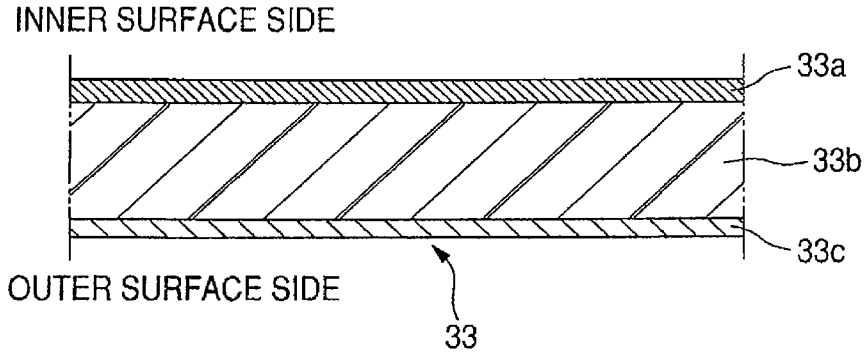
FIG. 6 is a schematic diagram showing a layer structure of a fixing film.

The belt 33 according to this embodiment has, as shown in the schematic diagram of the layer structure of FIG. 6, a three-layer composite structure in which a base layer 33*a*, an elastic layer 33*b*, and a releasing layer 33*c* are provided in the order from an inner surface side to an outer surface side. For the base layer 33*a*, it is possible to use a heat-resistant belt having a belt thickness of 100 μm or less, preferably 50 μm or less and 20 μm or more, in order to reduce the heat capacity and improve the quick-start ability. For example, a film made of polyimide, polyimide-amide, PEEK, PES, PPS, PTFE, PFA, FEP, or the like may be used. In this embodiment, a cylindrical polyimide belt having a diameter of 25 mm is used. For the elastic layer 33*b*, a silicone rubber having a rubber hardness of 10 degree (JIS-A), a heat conductivity of $4.18605\times10^{-1}$ W/m·degree ($1\times10^{-3}$ [cal/cm. sec. deg.]), and a thickness of 200 μm is used. For the releasing layer 33*c*, a PFA coating layer having a thickness of 20 μm is used. Alternatively, a PFA tube may be used therefor. The PFA coating is excellent in that a thickness cannot be increased, and is more effective in coating toner as compared with the PFA tube in terms of a quality of a material. On the other hand, the PEA tube is excellent compared to the PFA coating in terms of mechanical and electrical strengths, so both the PFA coating and the PFA tube can be used as the situation demands.

Figure 7:
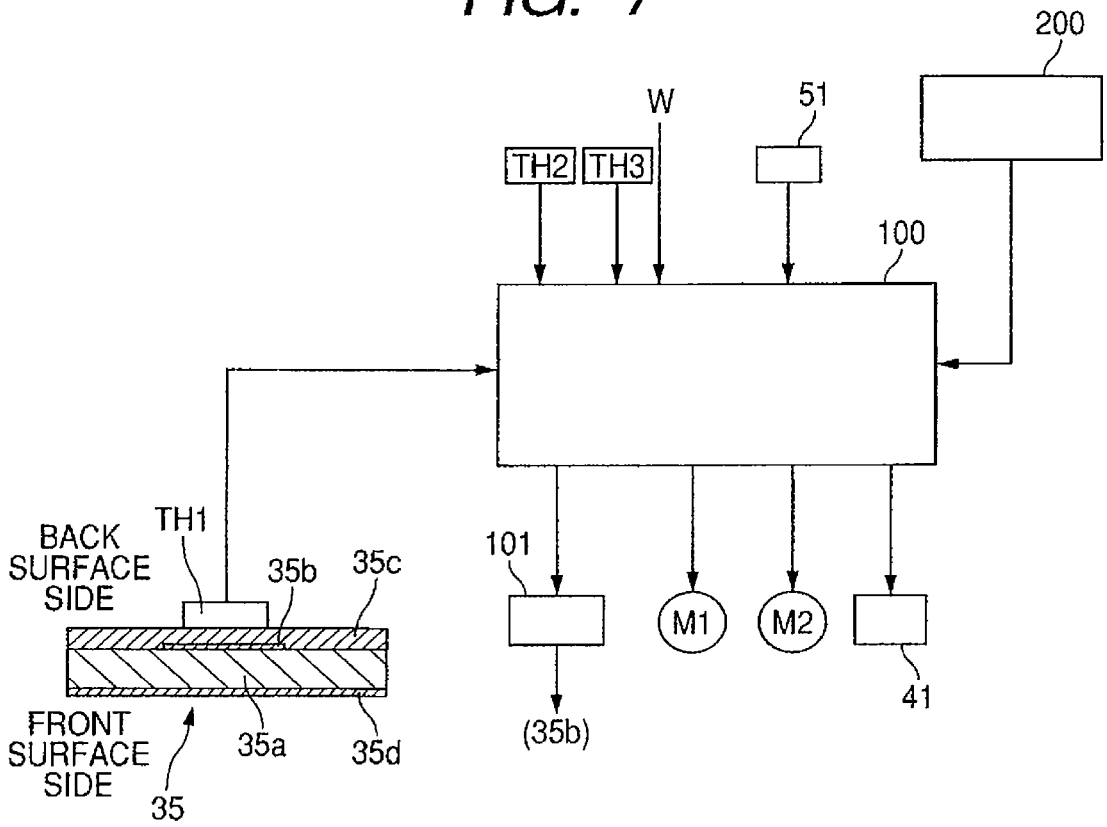
FIG. 7 is a cross-sectional view schematically showing a heater with a block diagram showing a control system.

The heater 35 according to this embodiment is of a back surface heating type using aluminum nitride or the like as a heater substrate, and is a horizontally-long linear heating member having a low heat capacity with a longitudinal side in a direction perpendicular to the movement direction of the fixing belt 33 and the recording material P. FIG. 7 is a schematic cross-sectional view of the heater 35 with a block diagram of a control system of the heater 35. The heater 35 includes a heater substrate 35*a* made of aluminum nitride or the like. The heater substrate 35*a* includes an energization heat generating layer 35*b* on the back surface side thereof (i.e., opposite surface side with the fixing film opposing surface side) which is provided along the longitudinal direction thereof, and is coated with an electrical resistance material such as argentum/palladium (Ag/Pd), with a thickness of about 10 μm and a width of 1 to 5 mm by screen printing or the like. Further, the heater 35 includes a protective layer 35*c* made of glass, a fluororesin, or the like on the energization heat generating layer 35*b*. In this embodiment, on a front surface side of the heater substrate 35*a* (i.e., belt opposing surface side), a sliding member (i.e., lubricating member) 35*d* is provided.

The heater 35 is fixingly supported by exposing the heater substrate surface side thereof provided with the sliding member 35*d* to be fitted into a groove portion which is provided along the longitudinal side of the guide at the substantial center of the outer surface of the guide member 34. In the fixing nip portion N, the surface of the sliding member 35*d* of the heater 35 and the inner surface of the belt 33 slide to be in contact with each other. Then, the belt 33 serving as a rotary image heating member is heated by the heater 35.

Figure 13:
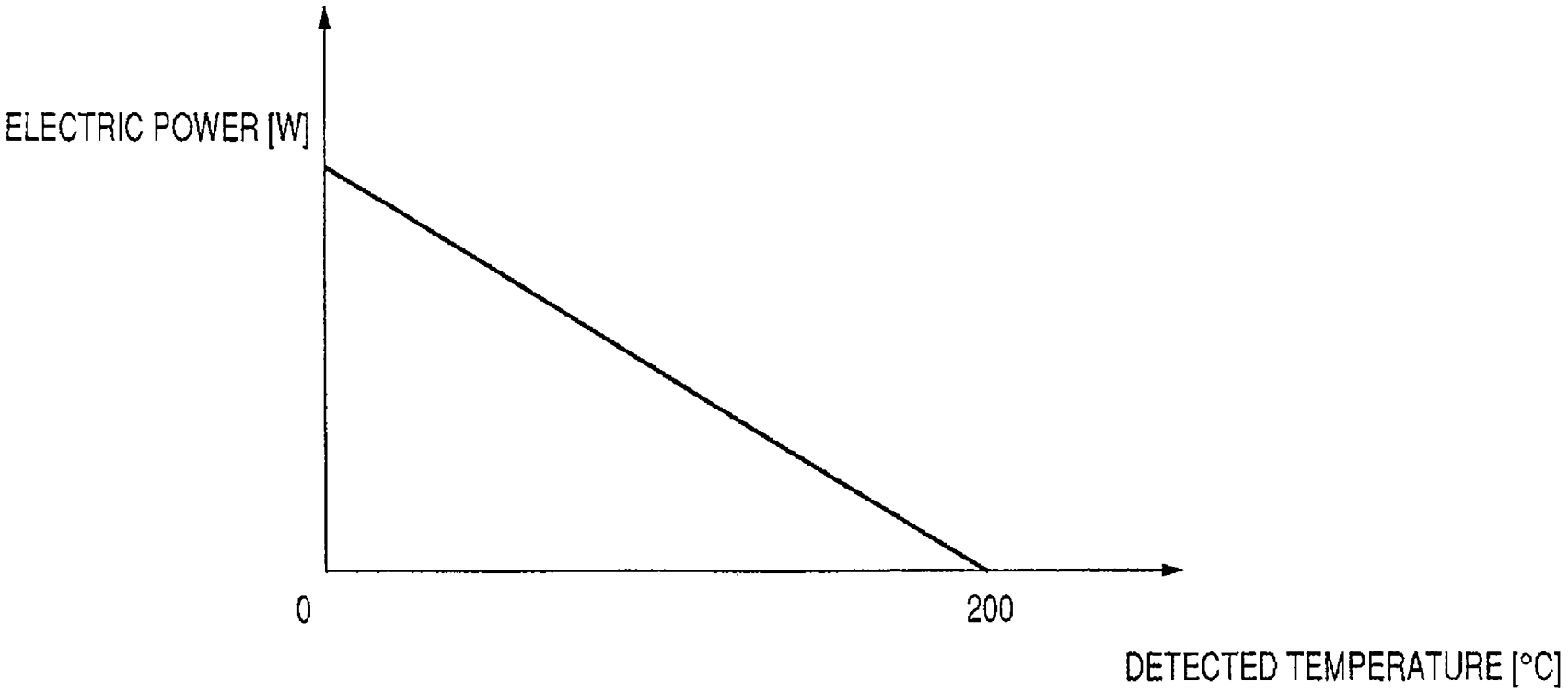
FIG. 13 is a view illustrating a temperature control system.

The energization heat generating layer 35*b* of the heater 35 is energized over longitudinal ends thereof, and the energization heat generating layer 35*b* is heated to rapidly raise the temperature of the heater 35 over an entire area of an effective heat generation width A in the longitudinal direction of the heater. The temperature of the heater is detected by a first temperature sensor (i.e., first temperature detecting means; central temperature sensor) TH1 such as a thermistor which is arranged by being brought into contact with the outer surface of the heater protective layer 35*c*. Then, an output of the detected temperature (i.e., signal value of the temperature) is inputted to the control circuit portion 100 through an A/D converter. The control circuit portion 100 controls energization from a power supply (i.e., power supply portion, or heater driving circuit portion) 101 to the energization heat generating layer 35*b* based on the detected temperature information to be inputted so as to maintain the temperature of the heater at a predetermined level. In other words, the temperature of the belt 33 serving as the heating rotary member heated by the heater 35 is controlled at a predetermined fixing temperature according to the output of the first temperature sensor TH1. In this embodiment, a proportional control system is adopted as a temperature control system. In the system, for example, as shown in FIG. 13, electrical power which is in proportion to a deviation of a set value (i.e., 220° C. in this embodiment) of the temperature of the heater and the temperature measured by the first temperature sensor TH1 is applied to the heater 35.

The pressure roller 32 is rotationally driven by a motor (i.e., drive means) M1 counterclockwise as indicated by the arrow. A torque acts on the belt 33 by a frictional force caused at the fixing nip portion N between the pressure roller 32 and the outer surface of the belt 33 due to the rotational driving of the pressure roller 32. As a result, the belt 33 is rotated around the guide member 34 in the counterclockwise direction indicated by the arrows while the inner surface thereof is sliding in close contact with the heater 35 (i.e., pressure roller driving method). The belt 33 is rotated at a circumferential speed substantially corresponding to a rotating circumferential speed of the pressure roller 32. Left and right flange portions 37*a* regulate an approaching movement by receiving the end portion of the belt at the approaching movement side when the rotating belt 33 is moved to approach leftward or rightward along the longitudinal side of the guide member 34. In order to reduce a mutual sliding frictional force generated in the fixing nip portion N between the heater 35 and the inner surface of the belt 33, the sliding member 35*d* is arranged on the surface of the heater in the fixing nip portion N, and a lubricant such as heat-resistant grease is mediated in the fixing nip portion N between the heater 35 and the inner surface of the belt 33.

Then, in response to a print start signal, the rotation of the pressure roller 32 is started, thereby starting heating-up of the heater 35. In a state when the rotating circumferential speed of the belt 33 is stabilized and the temperature of the heater 35 is raised at the predetermined temperature, the recording material P bearing a toner image "t" is introduced into the fixing nip portion N with the toner image bearing surface side as the belt 33 side. The recording material P is brought into close contact with the heater 35 through the belt 33 in the fixing nip portion N, thereby moving to pass the fixing nip portion N together with the belt 33. In the process of moving to pass the fixing nip portion N, the recording material P is provided with heat by the belt 33 heated by the heater 35, thereby heating and fixing the toner image "t" on the surface of the recording material P. The recording material P having passed the fixing nip portion N is separated from the surface of the belt 33 to be delivered and transported.

In this embodiment, transportation of the recording material P is performed by so-called central reference transportation in which the recording material is centered. In other words, with regard to any recording material with a variety of sizes in width which can pass the apparatus, a central portion of the recording material in the width direction thereof passes the central portion of the longitudinal direction of the fixing belt 33. Reference symbol S denotes a recording material sheet passing central reference line (i.e., virtual line).

Reference symbol W1 denotes a sheet passing width of the recording material having a maximum width (i.e., maximum sheet passing width) which can pass the apparatus. In this embodiment, the maximum sheet passing width W1 is an A4 landscape size width of 297 mm (i.e., A4 landscape feed). The effective heat generation region width A in the longitudinal direction of the heater is set to be slightly larger than the maximum sheet passing width W1. Reference symbol W3 denotes a sheet passing width of the recording material having a minimum width (i.e., minimum sheet passing width) which can pass the apparatus. In this embodiment, the minimum sheet passing width W3 is an A4 portrait size width of 210 mm (i.e., A4 portrait feed). Reference symbol W2 denotes a sheet passing width of the recording material having a width between the width of the maximum width recording material and the width of the minimum width recording material. In this embodiment, the sheet passing width W2 is a B4 portrait size width of 257 mm (i.e., B4 portrait feed). Hereinafter, the recording material having a width corresponding to the maximum sheet passing width W1 is represented as a maximum-size recording material, and the recording material having a width smaller than the maximum-size recording material is denoted as a small-size recording material.

Reference symbol "a" denotes a differential width portion ((W1−W2)/2) between the maximum sheet passing width W1 and the sheet passing width W2, and reference symbol "b" denotes a differential width portion ((W1−W3)/2) between the maximum sheet passing width W1 and the minimum sheet passing width W3. In other words, each of the differential width portions "a" and "b" is a non-sheet passing portion generated when the B4 or A4 portrait size recording material, which is a small-size recording material, passes the apparatus. In this embodiment, the recording material sheet passing is performed by the central reference, so the non-sheet passing portions "a" and "b" are generated in left and right side portions of the sheet passing width W2 and in left and right side portions of the sheet passing width W3. The width of the non-sheet passing portion varies depending on the size of the width of the small-size recording material used for sheet passing.

The first temperature sensor TH1 is arranged to detect the temperature of the heater (i.e., temperature of the sheet passing portion) provided in the area corresponding to the minimum sheet passing width W3. A second temperature sensor TH2 (i.e., second temperature detecting means; end portion temperature sensor) such as a thermistor detects the temperature of the non-sheet passing portion. The output of the detected temperature (i.e., signal value of the temperature) is inputted to the control circuit portion 100 through an A/D converter. In this embodiment, the temperature sensor TH2 is arranged to be elastically in contact with an inner surface of a base layer of a fixing belt portion which corresponds to the non-sheet passing portion "a". To be specific, the temperature sensor TH2 is arranged at a free end of an elastic supporting member 38 having a shape of a plate spring, whose base is fixed to the guide member 34. By elastically abutting the temperature sensor TH2 against the inner surface of the base layer 33*a* of the belt 33 by the elasticity of the elastic supporting member 38, the temperature of the belt portion corresponding to the non-sheet passing portion "a" is detected.

It should be noted that the first temperature sensor TH1 may be arranged to be elastically brought into contact with the inner surface of the base layer of the belt portion corresponding to the sheet passing width W3. Meanwhile, the second temperature sensor TH2 may be arranged to detect the temperature of the heater corresponding to the non-sheet passing portion "a".

(2-2) Air Blowing/Cooling Mechanism Portion 20B

Figure 8:
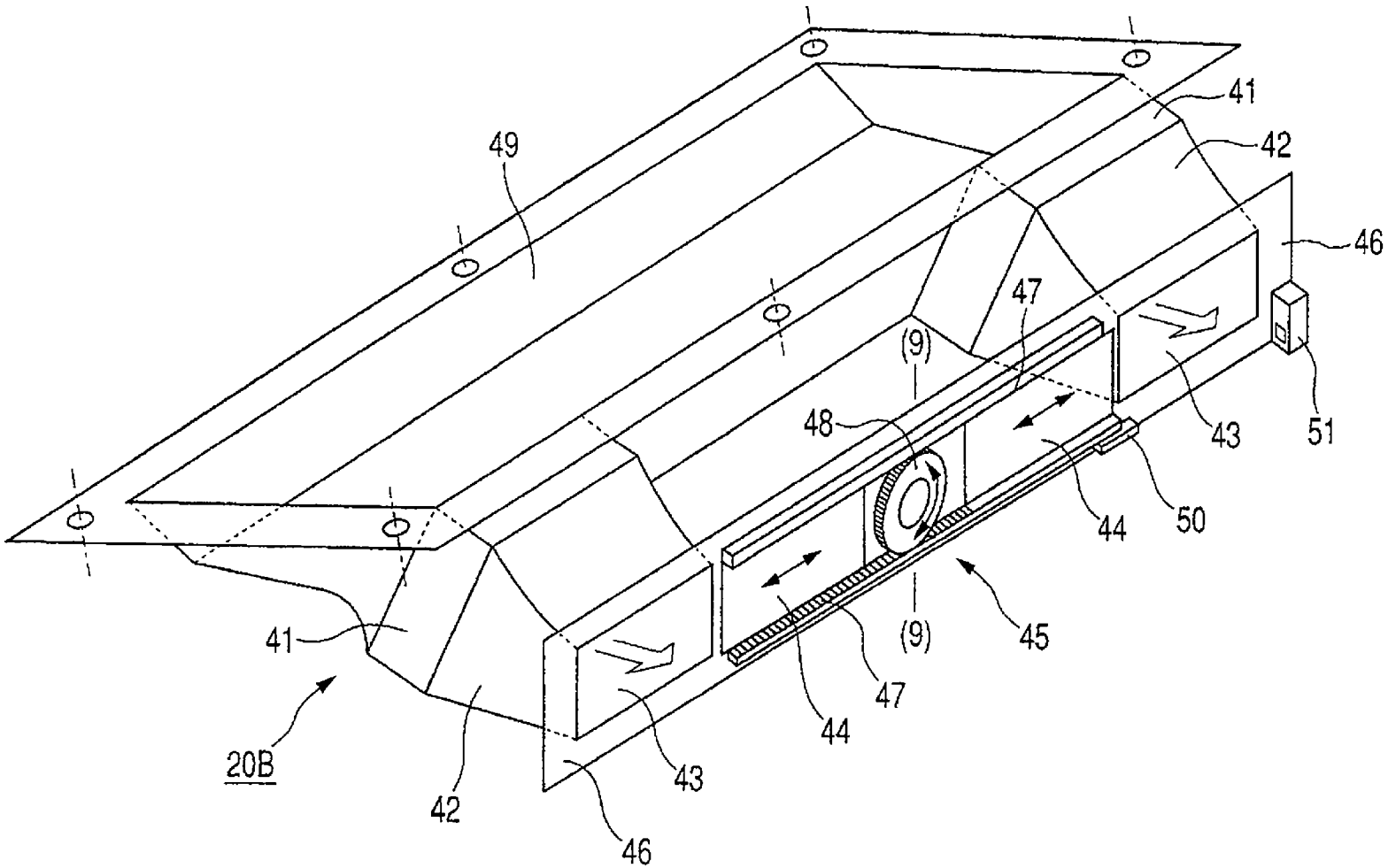
FIG. 8 is a perspective view schematically showing an external appearance of an air blowing/cooling mechanism portion.
Figure 9:
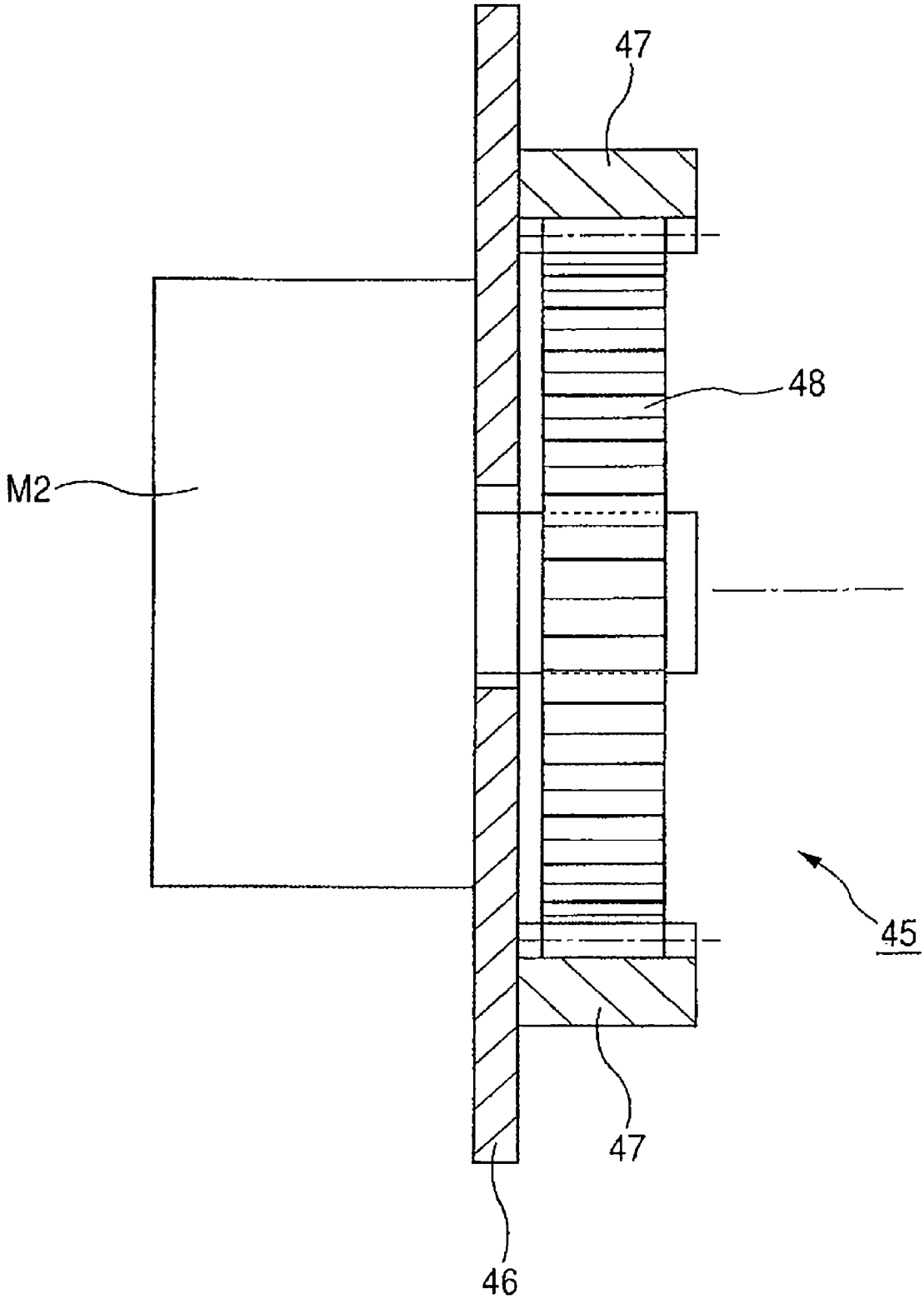
FIG. 9 is an enlarged view taken along the line (9)-(9) shown in FIG. 8.

An air blowing/cooling mechanism portion 20B is cooling means for decreasing the raised temperature of the non-sheet passing portion of the belt 33 serving as a heating rotary member, occurring when small-size recording materials are continuously supplied (i.e., small-size job), by air blowing. FIG. 8 is a perspective view schematically showing an external appearance of the air blowing/cooling mechanism portion 20B. FIG. 9 is an enlarged cross-sectional view taken along a line (9)-(9) in FIG. 8.

Referring to FIGS. 2, 8, and 9, the air blowing/cooling mechanism portion 20B according to this embodiment will be described. The air blowing/cooling mechanism portion 20B includes air blowing (i.e., cooling) fans (hereinafter, sometimes briefly referred to as "fan") serving as air blowing means. Further, the air blowing/cooling mechanism portion 20B includes air blowing ducts 42 for guiding air generated by the fans 41, and air blowing ports (i.e., air duct opening portions) 43 which are arranged in a portion opposing the belt 33 of the air blowing ducts 42. Still further, the air blowing/cooling mechanism portion 20B includes shutters (i.e., closure plates) 44 for regulating an opening width of the air blowing ports 43 as a width appropriate to the width of the recording material to be passed, and a shutter driving device (i.e., an opening width regulating means or air blowing width regulating device) 45 for driving the shutters 44.

The fans 41, the air blowing ducts 42, the air blowing ports 43, and the shutters 44 are arranged symmetrically with respect to the left and right portions of the belt 33 in the longitudinal direction thereof. An intake channel portion 49 is arranged at an intake side of the fan 41. For the fan 41, a centrifugal fan such as a sirocco fan may be used.

The left and right shutters 44 are slidably supported in a horizontal direction along a plate surface of a supporting plate 46, in which the air blowing ports 43 are provided, extending in the horizontal direction thereof. The left and right shutters 44 are communicated with each other by providing racks 47 and a pinion gear 48, and the pinion gear 48 is driven by a normal rotation or a reverse rotation by a motor (i.e., pulse motor) M2. As a result, the left and right shutters 44 are operated in association with each other, thereby being opened/closed in a symmetrical relation with respect to the air blowing ports 43 each corresponding thereto. The shutter driving device 45 is constituted of the supporting plate 46, the racks 47, the pinion gear 48, and the motor M2.

The left and right air blowing ports 43 are provided from a position which is a little close to the center from the non-sheet passing portion "b", which is generated when the minimum width recording material is passed, to the left and right ends of the maximum sheet passing width W1. The left and right shutters 44 are arranged in directions in which the air blowing ports 43 are closed outward from a longitudinal middle part of the supporting plate 46 by a predetermined amount.

To the control circuit portion 100, based on information such as an input of a size of a recording material to be used by a user, and a recording material width automatic detecting mechanism (not shown) of a sheet feeding cassette 13 or the manual feed tray 17, width information W (see FIG. 7) of a recording material to be passed is input. Then, the control circuit portion 100 controls the shutter driving device 45 based on the information. In other words, the pinion gear 48 is rotated by driving the motor M2, and the shutters 44 are moved by the racks 47, thereby making it possible to open the air blowing ports 43 by the predetermined amount.

Figure 10:
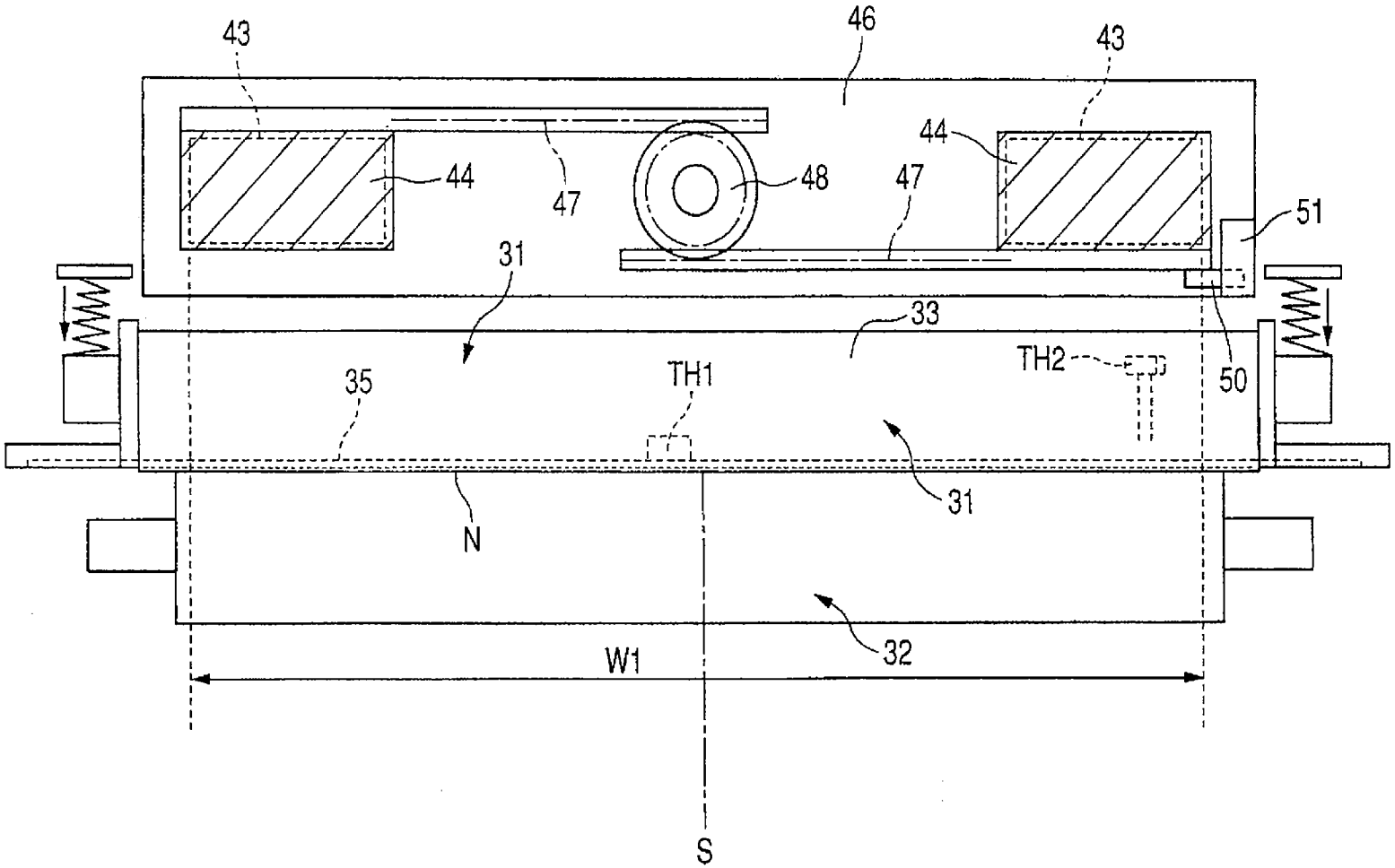
FIG. 10 is a constitutional diagram showing a state in which shutters are each moved to a fully-closed position in which air blowing ports are fully closed.
Figure 11:
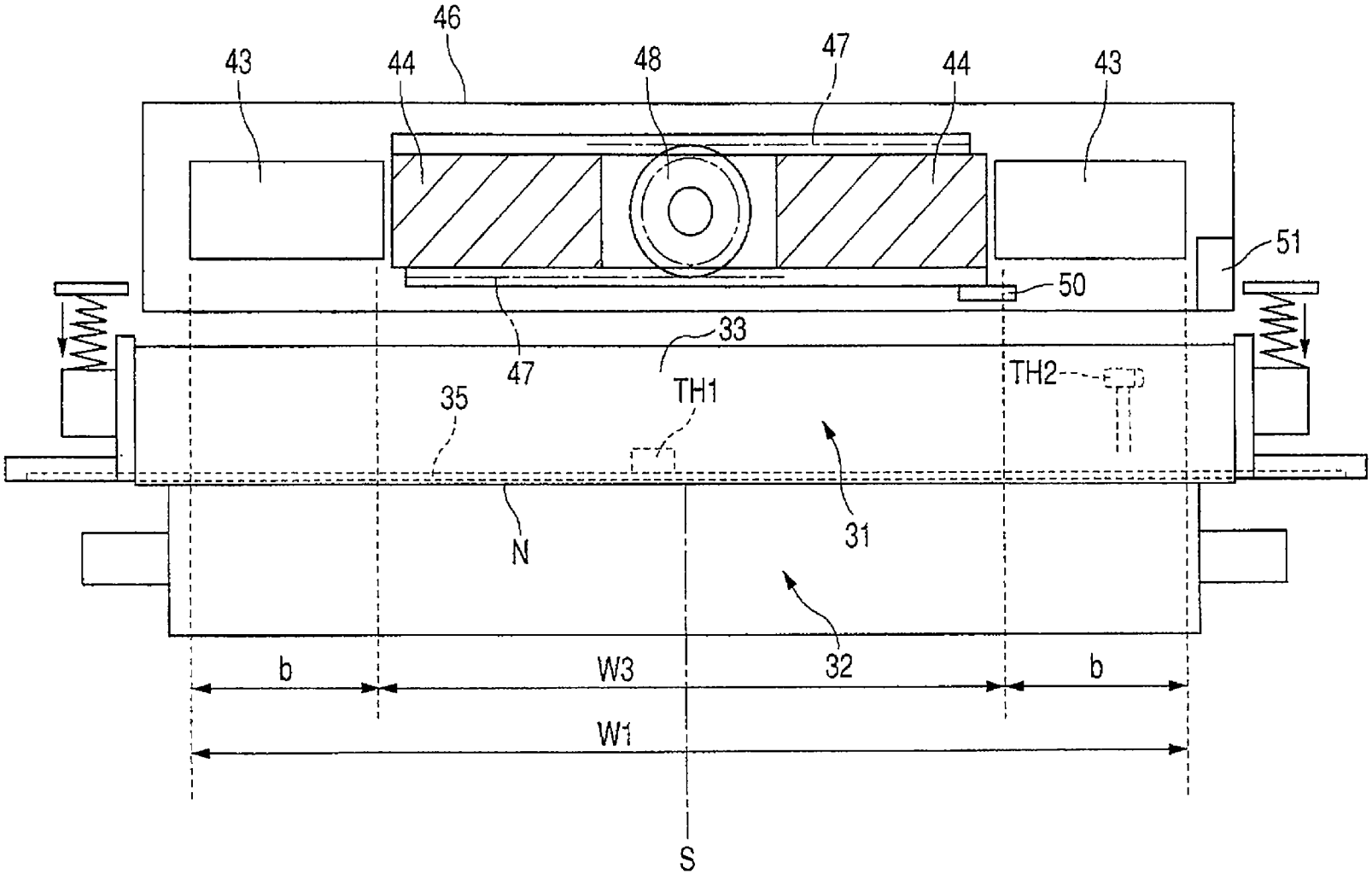
FIG. 11 is a constitutional diagram showing a state in which the shutters are each moved to a fully-opened position in which the air blowing ports are fully opened.
Figure 12:
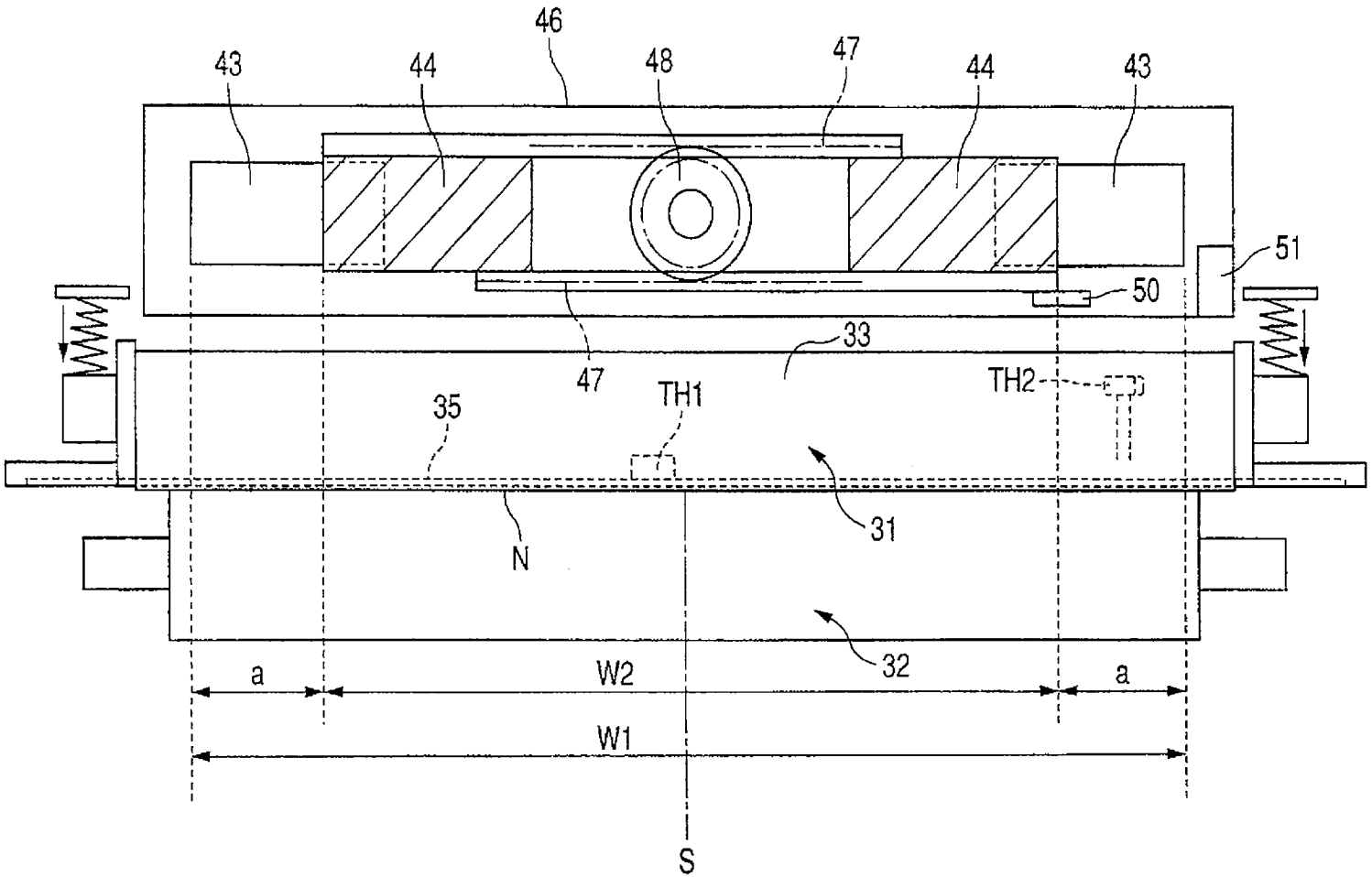
FIG. 12 is a constitutional diagram showing a state in which the shutters are each moved to a position in which only a portion of the air blowing port corresponding to a non-sheet passing portion "a" is opened.

The control circuit portion 100 controls the shutter driving device 45 to move the shutters 44 to a fully-closed position where the air blowing ports 43 are fully closed, as shown in FIG. 10, when the width information of the recording material indicates a maximum-size recording material (i.e., A4 landscape size width). On the other hand, the control circuit portion 100 controls the shutter driving device 45 to move the shutters 44 to a fully-opened position where the air blowing ports 43 are fully opened, as shown in FIG. 11, when the width information of the recording material indicates a small-size recording material of an A4 portrait size width. When the width information of the recording material indicates a small-size recording material of a B4 portrait size width, the control circuit portion 100 controls the shutter driving device 45 to move the shutters 44 to a position where only a portion of the air blowing ports 43, which corresponds to the non-sheet passing portion "a", is opened, as shown in FIG. 12.

That is, by the shutters 44, the opening width of the air blowing ports 43 can be adjusted in accordance with the length in the width direction of a recording material.

It should be noted that, not shown in the drawings, in a case where the small-size recording material to be passed is LTR-R, EXE, K8, LTR, or the like, the control circuit portion 100 controls the shutter driving device 45 to move the shutters 44 to a position where the portion of the air blowing ports 43, which corresponds to the non-sheet passing portion, is opened.

The minimum, maximum, and full sheet sizes in this embodiment are specification sheets guaranteed by the image forming apparatus main body, and are not undefined sized sheets used by the user for his/her own purpose.

In order to detect positional information on the shutters 44, a sensor 51 arranged on the supporting plate 46 detects a flag 50 arranged at a predetermined position of the shutter 44. To be specific, as shown in FIG. 10, a home position is set at a shutter position where the air blowing ports 43 are fully closed, thereby detecting the opening amount based on a rotational amount of the motor M2.

It is also possible that an opening width detecting sensor for directly detecting current positions of the shutters 44 is provided, and shutter position information detected by the sensor is fed back to the control circuit, thereby controlling the shutters 44 to move to an appropriate opening width position corresponding to the width of the recording material to be passed. A stop position of the shutter corresponding to the length in the width direction of the small-size recording material is set with high precision by detecting an edge position of the shutter by the sensor. Accordingly, it is possible to blow cooling air only for the non-sheet passing area of any small-size recording material.

(2-3) Cooling Sequence of Non-Sheet Passing Portion

Hereinafter, the cooling sequence of a non-sheet passing portion of the fixing mechanism portion 20A, which is a characteristic part of this embodiment, after small-size recording materials are supplied continuously, will be described.

Figure 14A:
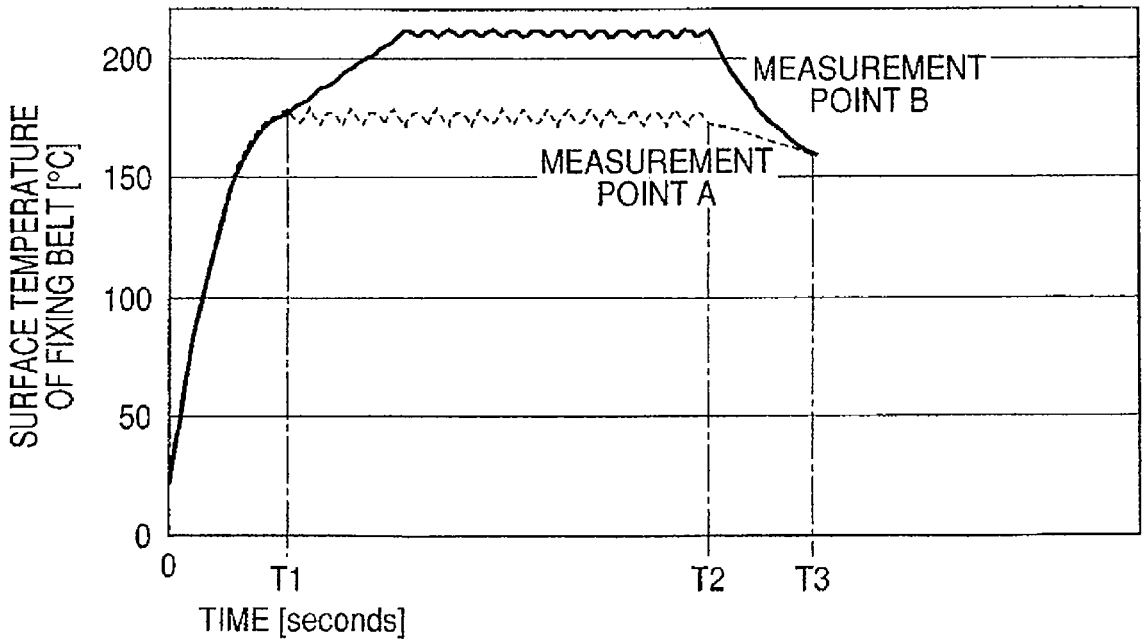
FIG. 14A is a view illustrating a temperature transition.
Figure 14B:
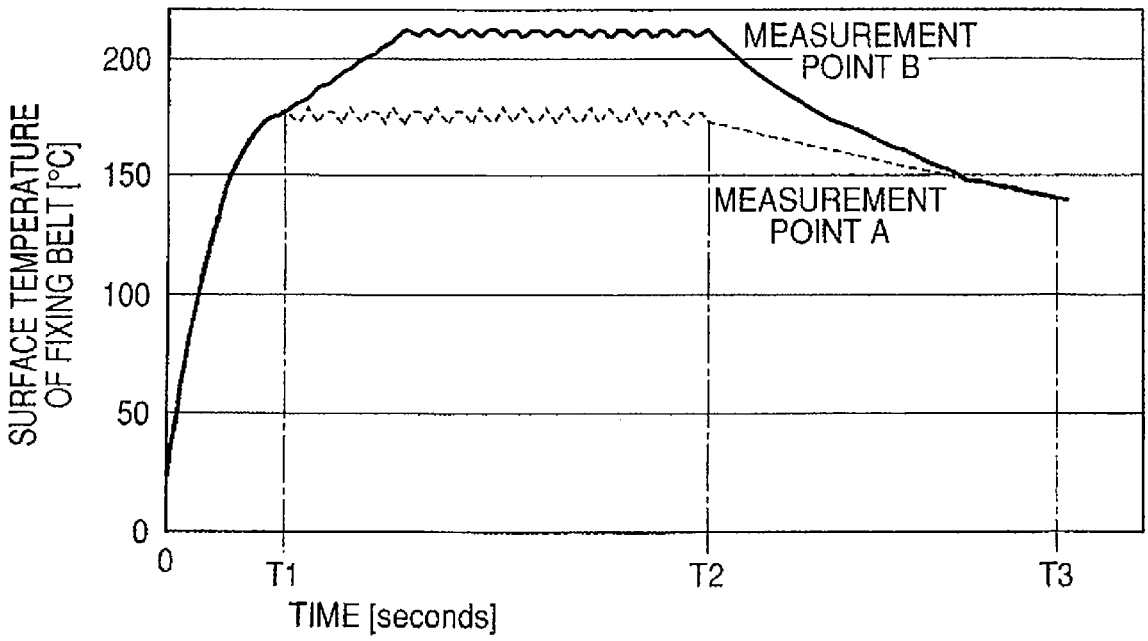
FIG. 14B is a view illustrating a temperature transition.
Figure 14C:
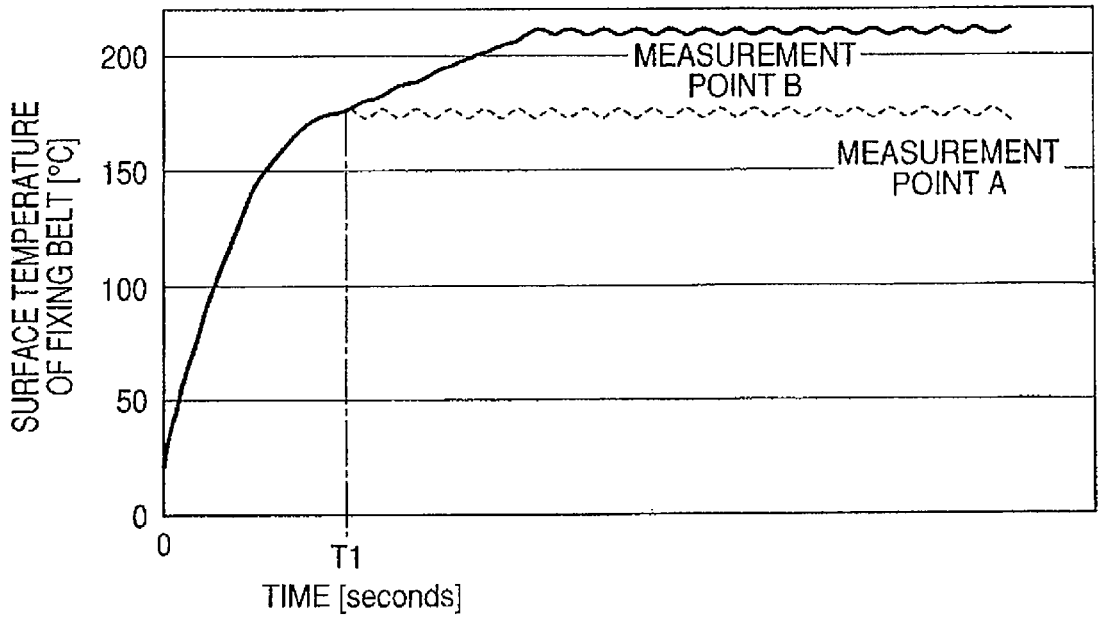
FIG. 14C is a view illustrating a temperature transition.
Figure 15:
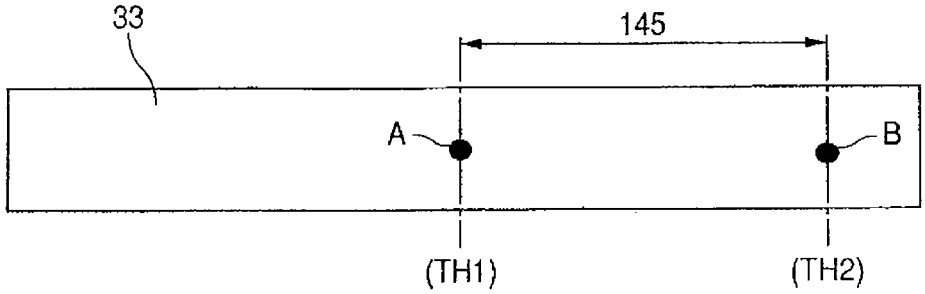
FIG. 15 is a view illustrating a temperature measurement position of a fixing belt surface.

First, FIG. 14C illustrates the temperature transition of the surface of a fixing belt 33 when small-size recording materials are continuously supplied. In this embodiment, a small-size recording material is set to be an A4 portrait sheet, a maximum-size recording material is an A4 landscape sheet, and the respective lengths in the width direction are about 210 mm and about 297 mm. Further, as shown in FIG. 15, measurement points A and B in FIG. 14C substantially correspond to the vicinity of the center of a sheet passing area of the fixing belt 33, and the second temperature sensor TH2 for detecting the temperature of a non-sheet passing area of the fixing belt 33.

Substantially at the same time as the image formation start of the image forming apparatus, the motor M1 is driven. The heat generating layer 35*b* of the heater 35 starts being energized, and the heat generating layer 35*b* generates heat to heat the fixing belt 33 and the pressure roller 30.

When the signal value detected by the first temperature sensor TH1 becomes a predetermined signal value (a signal value corresponding to 220° C. in the case of this embodiment), the heater 35 is maintained in the vicinity of 220° C. by a proportional control system described in FIG. 13.

After the elapse of a predetermined time T1 (substantially after 10 seconds in this embodiment) from the start of energization of the heater 35 (represented by 0 second in FIGS. 14A to 14C), the A4 portrait sheets carrying an unfixed toner image start being supplied. The temperature of the surface of the fixing belt 33 at this time is about 175° C. at both the points A and B.

When the heater 35 is set in the vicinity of 220° C. by the above-mentioned proportional control system during sheet supply, at the point A of the sheet passing area, the heat removal amount by the recording material and the heating amount by the heater 35 are balanced. Therefore, even though ripples of several degrees occur, the temperature of the surface of the fixing belt 33 becomes about 175° C., substantially constantly. However, the temperature of the surface of the fixing belt 33 at the point B of the non-sheet passing area, where the heat removal by the recording material does not occur, rises to reach about 210° C.

When the continuous sheet supply of the A4 portrait sheets is completed (i.e., time T2), and the A4 landscape sheet is supplied immediately, hot-offset occurs in a portion of the A4 portrait sheet corresponding to the non-sheet passing area. This is a phenomenon occurring due to the remarkable decrease in viscoelasticity of the toner in the case where the temperature of the surface of the fixing belt 33 is 190° C. or higher.

In order to prevent the hot-offset, in the conventional belt fixing apparatus, large-size sheets are continuously supplied after the non-sheet passing area of the fixing belt 33 decreases to a predetermined temperature.

Figure 1A:
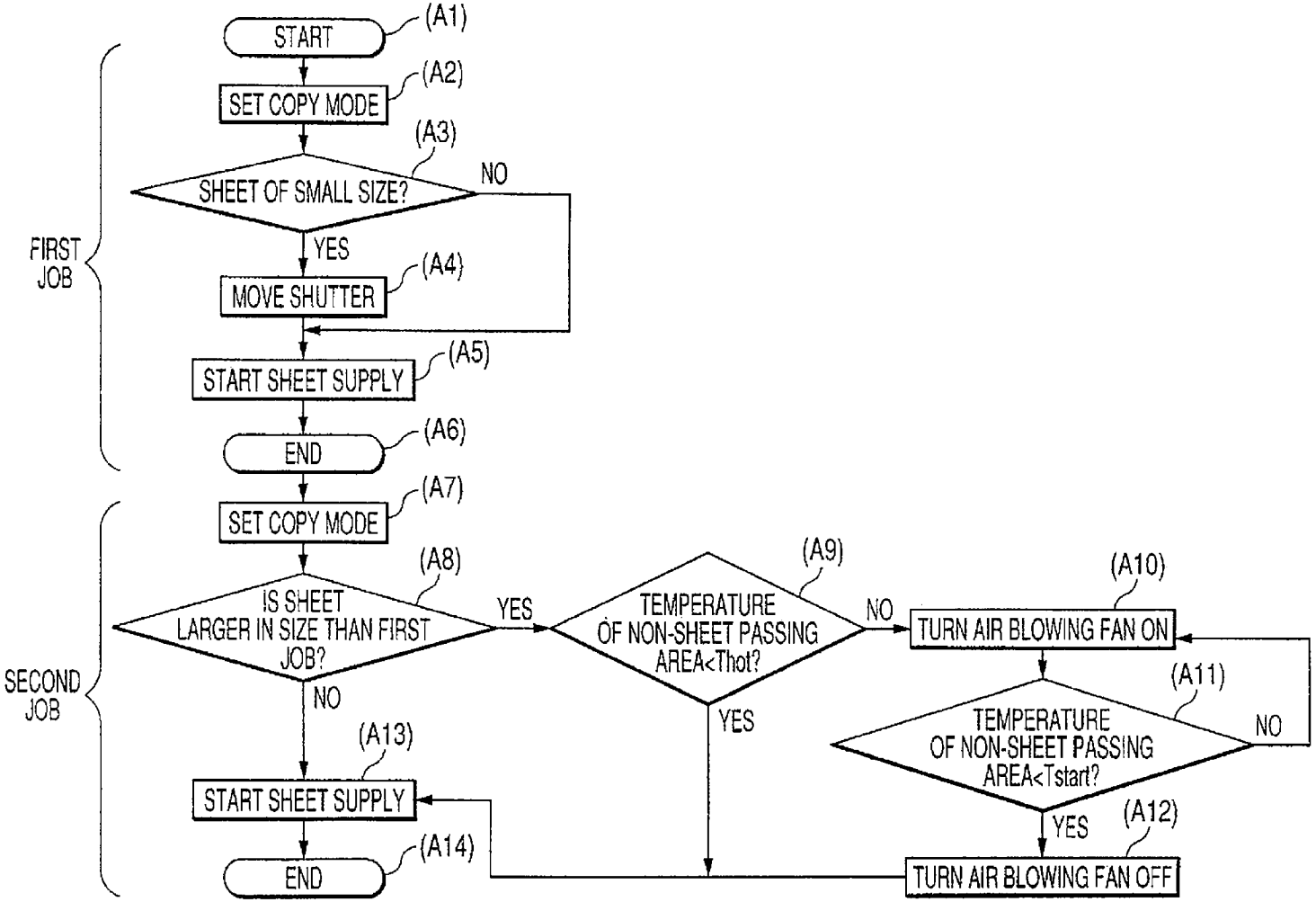
FIG. 1A is a flowchart illustrating a cooling method.
Figure 1B:
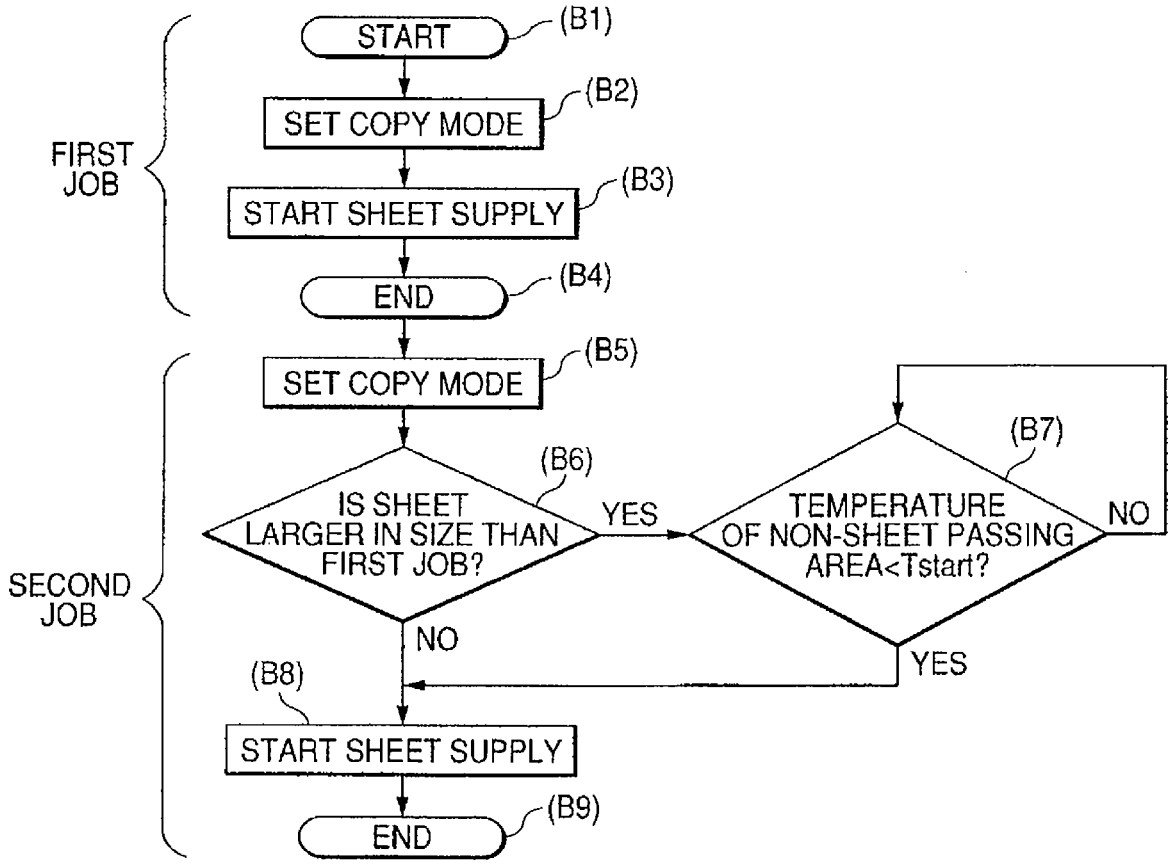
FIG. 1B is a flowchart illustrating a cooling method.

FIG. 1B is a flowchart showing an example thereof. That is, in the case where A4 portrait sheets are supplied continuously as a first job, it is determined that a recording material has an A4 portrait sheet size from the set size of a copying mode (Step B2), and the sheet supply is started (Step B3). In the case where A4 landscape sheets are supplied as a second job after the completion of the first job, it is determined that a recording material has an A4 landscape size from the set size of a copying mode (Steps B5 and B6).

In the case where a sheet size is larger than that of a recording material of the previous job, when the temperature detected from the signal value of the second temperature sensor TH2 for detecting the temperature of a non-sheet passing area is a large-size sheet passing possible temperature Thot or lower (Step B7), a maximum-size sheet is supplied immediately. The temperature detected from the signal value of the second temperature sensor TH2 will be referred to as a non-sheet passing area temperature.

However, in the case where the non-sheet passing area temperature is equal to or higher than the large-size sheet passing possible temperature Thot, the A4 landscape sheets are supplied after the non-sheet passing area temperature reaches Tstart or lower. In the conventional fixing apparatus, Thot is 190° C., at which hot-offset occurs, and Tstart is 140° C., at which the with-direction temperature of the fixing belt 33 becomes uniform.

FIG. 14B shows a specific temperature transition. As described above, after the A4 portrait sheets are continuously supplied, the non-sheet passing area temperature of the surface of the fixing belt 33 becomes 210° C., which is higher than Thot. At this time, when the pressure roller 32 and the fixing belt 33 are driven without energizing the heater 35, the temperature over the entire area in the width direction of the fixing belt 33 becomes uniform. The reason for this is that the difference in temperature between the non-sheet passing area (i.e., point B) and the environment is larger, compared with the difference in temperature between the sheet-passing area (i.e., point A) and the environment, so that the temperature decreases faster.

In the fixing apparatus of this embodiment, the temperature over the entire area in the width direction of the fixing belt 33 becomes uniform about 45 seconds (i.e., T2 to T3) after the completion of the supply of the A4 portrait sheets. After that, when the heater 35 is energized, and the surface temperature of the fixing belt 33 rises to about 175° C., the supply of the A4 landscape sheets is started. In this case, the downtime is about 45 seconds.

Next, air blowing/cooling after small-size recording materials are continuously supplied in the fixing apparatus of this embodiment will be described.

FIG. 1A is a flowchart showing the procedure thereof. The control circuit portion 100 determines that a recording material has an A4 portrait size from the set size of a copying mode, in the case where A4 portrait sheets are continuously supplied as a first job (Step A2). Then, the supply of sheets is started (Step A5) after the air blowing width is allowed to correspond to the non-sheet passing area of the A4 portrait sheets (see FIG. 12) by the movement of the shutters 44 of the air blowing/cooling mechanism portion 20B. The movement of the shutters 44 only needs to be performed until the completion of the first job, and the shutters 44 may be moved during the sheet supply.

In the case when the A4 landscape sheets are supplied as a second job after the completion of the first job, it is determined that a recording material has an A4 landscape size from the set size of a copying mode (Steps A7 and A8). In the case when the recording material has a size larger than that of the recording material in the previous job, when the non-sheet passing area temperature is equal to or lower than the large-size sheet passing possible temperature Thot (Step A9), maximum-size sheets are supplied immediately. However, when the non-sheet passing area temperature is equal to or higher than the large-size sheet passing possible temperature Thot, the air blowing fan 41 is turned on immediately, and cooling air is blown to the non-sheet passing area of the A4 portrait size of the fixing mechanism portion 20A to perform air blowing/cooling (Steps A10 and A11). After the non-sheet passing area temperature reaches Tstart or lower, the air blowing fan 41 is turned off (Step A12), and A4 landscape sheets are supplied. In the fixing apparatus of this embodiment, Thot is 190° C., at which hot-offset occurs, and Tstart is 160° C., at which the width-direction temperature of the fixing belt 11 becomes uniform.

FIG. 14A shows specific temperature transition and time transition. As described above, after the continuous supply of the A4 portrait sheets, the non-sheet passing area temperature of the surface of the fixing belt 33 reaches 210° C. which is higher than Thot. At this time, when the pressure roller 32 and the fixing belt 33 are driven without energizing the heater 35, and air blowing/cooling is performed with the air blowing width set to the non-sheet passing area of an A4 portrait sheet, the non-sheet passing area temperature decreases rapidly, and the temperature over the entire area in the width direction of the fixing belt 33 becomes uniform.

The temperature over the entire area in the width direction of the fixing belt 33 becomes uniform about 10 seconds after the completion of the supply of A4 portrait sheets in the fixing apparatus of this embodiment. After that, when the heater 35 is energized, and the surface temperature of the fixing belt 33 reaches about 175° C., the supply of A4 landscape sheets is started. In this case, the downtime is about 10 seconds. That is, the downtime can be shortened by about 35 seconds by performing the air blowing/cooling.

By setting the air blowing width to the non-sheet passing area of a small-size recording material with the shutter driving device (i.e., air blowing width regulating device) 45 at latest during the supply of a small-size recording material, cooling air can be blown to the non-sheet passing area surface to cool the surface immediately after the completion of the continuous supply of small-size recording materials.

That is, by setting the air blowing width to the non-sheet passing area of a small-size recording material with the shutter driving device 45 at the latest during the supply of small-size recording materials, the downtime required for changing the air blowing width can be eliminated.

Since the length in the width direction of an air blowing port is adjusted in accordance with the length in the width direction of a recording material, only the fixing belt surface of the non-sheet passing area can be cooled. Thus, energy can be used effectively without cooling the fixing belt surface in the sheet-passing area uselessly.

By turning on/off an air blowing fan with the signal value detected by the temperature detection means TH2 for detecting the temperature of a non-sheet passing area surface, the downtime can be minimized while hot-offset occurring in the subsequent large-size sheet is prevented.

This embodiment does not limit the present invention, and the fixing belt, the heat generating body, the recording material size, and the like are merely examples thereof. Further, various temperatures such as the large-size sheet passing possible temperature only need to be determined appropriately based on the characteristics of the fixing apparatus and toner to be used, and are not limited by this embodiment. In addition, even though the fixing belt is cooled with the air blowing/cooling mechanism portion 20B in this embodiment, the cooling method is not limited thereto, and the pressure member or both of the fixing member and the pressure member may be cooled. Further, in the case where the pressure member is a belt material having a small heat capacity, a cooling effect increases, and the downtime can be further reduced.

Further, according to the present invention, in the case where small-size recording materials are supplied continuously, and then, small-size recording materials that are larger than the previous small-size recording materials are supplied, for example, in the case where B4 portrait sheets are supplied after A4 portrait sheets are continuously supplied, the same effects can be obtained.

Thus, only a non-sheet passing portion can be cooled by air blowing, by regulating the opening width of an air blowing port in accordance with the width of a small-size recording material to be supplied, so that energy can be used effectively without cooling the sheet-passing portion uselessly.

By adjusting the opening width of the air blowing port before or during the continuous supply of small-size recording materials, only a non-sheet passing portion can cooled with cooling means immediately after the completion of the continuous supply of small-size recording materials. Because of this, the downtime required for changing the opening width of the air blowing port can be further reduced.

By turning on/off the cooling means based on the temperature detected by the temperature detection means for detecting the temperature of a non-sheet passing portion, the downtime can be minimized while hot-offset occurring in a subsequent large-size recording material is prevented.

By blowing cooling air only to the non-sheet passing portion even during the continuous supply of small-size recording materials, thereby reducing the increase in temperature of the non-sheet passing portion, the cooling time after the continuous supply of small-size recording materials can be reduced.

As described above, even in a fixing belt type apparatus using a heating rotary member with a low heat capacity, the downtime can be reduced remarkably, which is required for making the temperature distribution over the entire heating area uniform after the continuous supply of small-size recording materials.

Second Embodiment

In this embodiment, a fixing apparatus will be described, in which a non-sheet passing portion of the fixing mechanism portion 20A is cooled with the air blowing/cooling mechanism portion 20B even during the continuous supply of small-size recording materials in addition to the completion the continuous supply of small-size recording materials.

By blowing cooling air only to the non-sheet passing portion even during the continuous supply of small-size recording materials to reduce the increase in temperature of the non-sheet passing portion, the cooling time after the continuous supply of small-size recording materials can be reduced.

That is, in the image heating apparatus of the present invention, the downtime can be reduced remarkably, which is required for making the temperature distribution over the entire heating area uniform after the continuous supply of small-size recording materials even in a fixing belt type apparatus that uses a heating rotator with a low heat capacity.

The configuration, the control system, and the like of the fixing apparatus of this embodiment are the same as those described in the first embodiment, except for the timing at which the air blowing/cooling mechanism portion 20B cools the non-sheet passing portion of the fixing mechanism portion 20A.

Air blowing/cooling that is a characteristic point of the fixing apparatus of this embodiment will be described, which is performed even during the continuous supply of small-size recording materials.

Figure 16A:
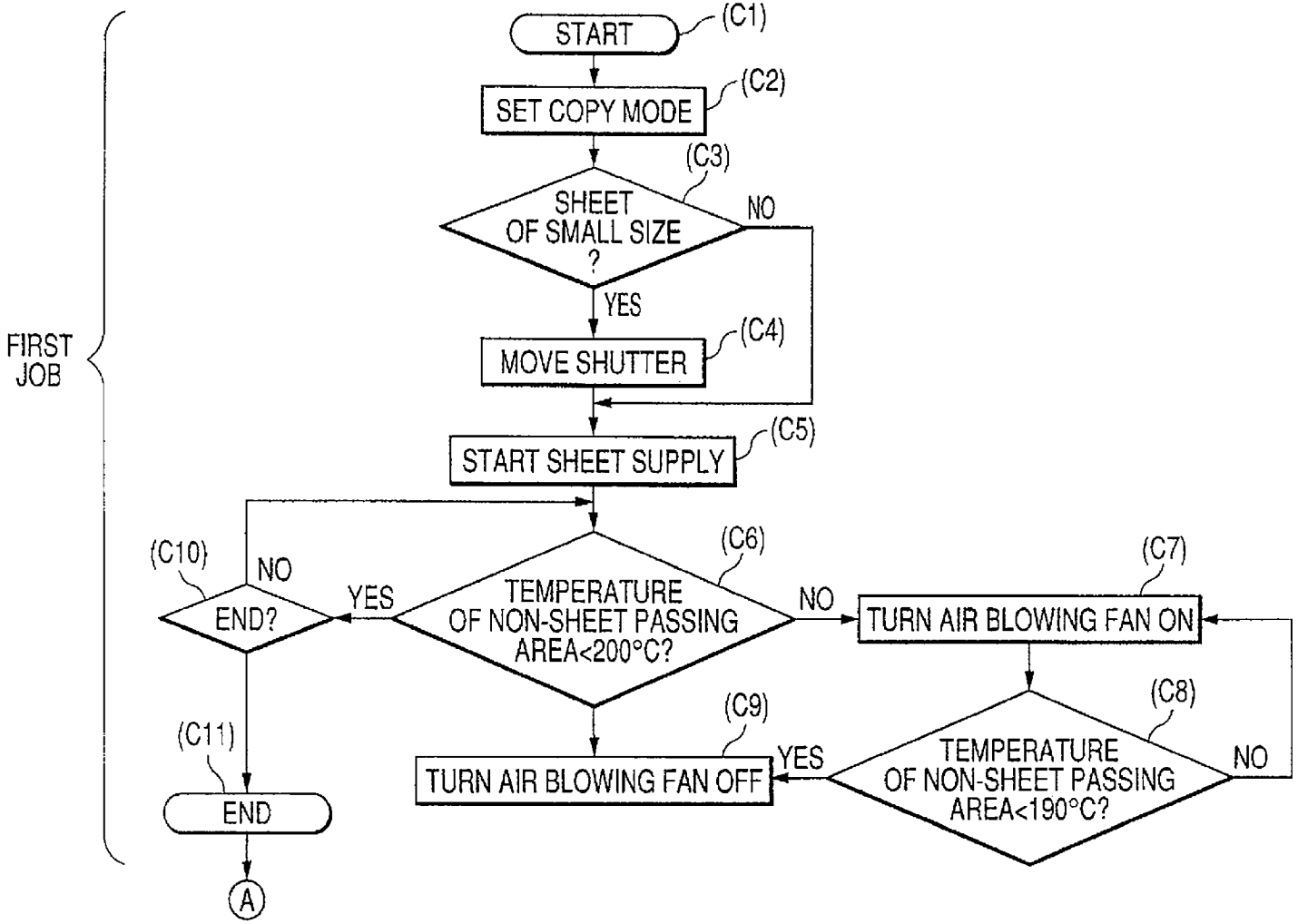
FIG. 16A is a flowchart illustrating a cooling method of a second embodiment of the present invention.
Figure 16B:
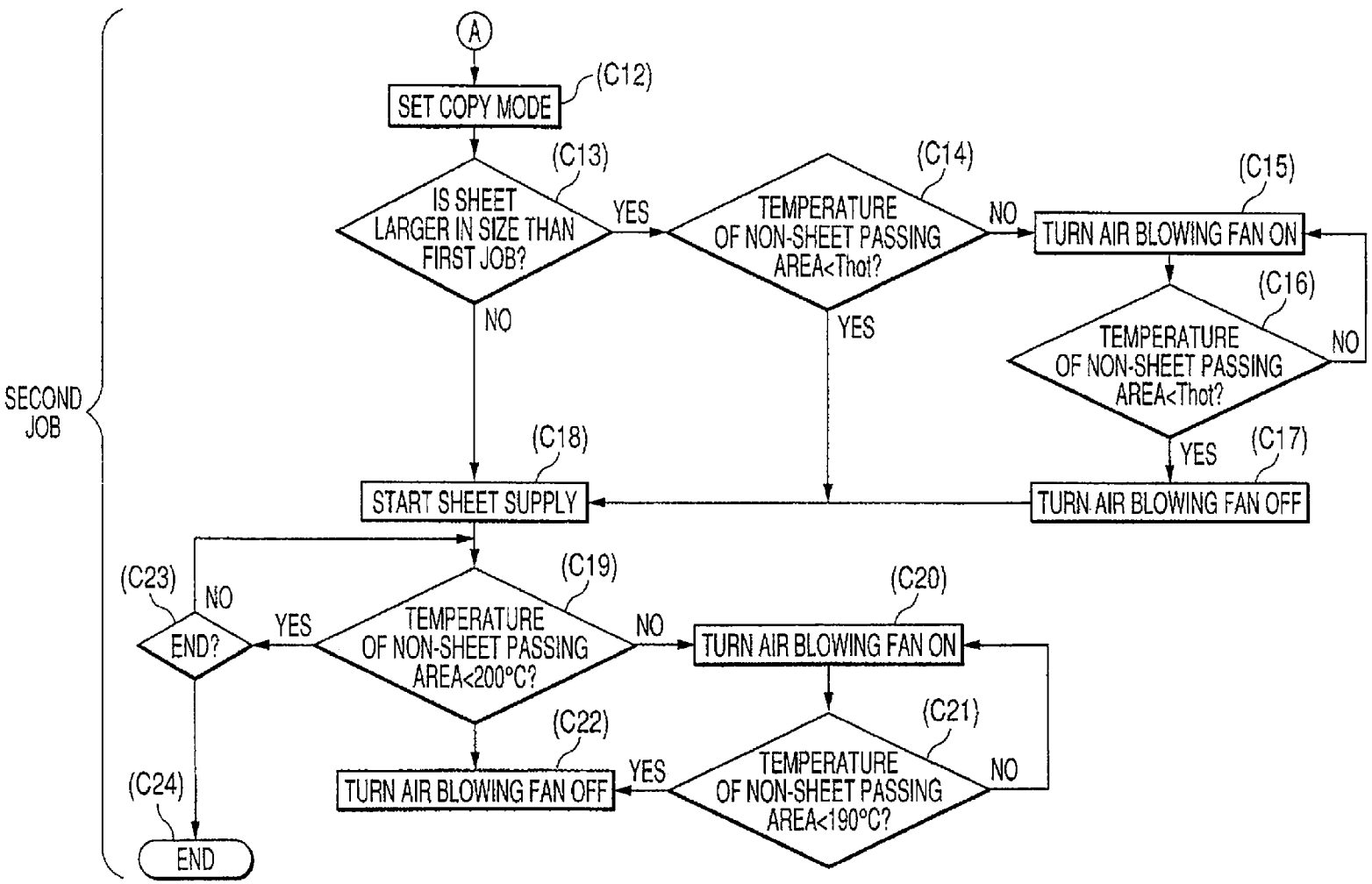
FIG. 16B is a flowchart illustrating a cooling method of the second embodiment of the present invention.

FIGS. 16A and 16B are flowcharts showing the procedure thereof.

In the case where A4 portrait sheets are continuously supplied as a first job, the control circuit portion 100 determines that the recording material has an A4 portrait size from the set size of a copying mode (Step C2). Then, after the air blowing width is allowed to correspond to the non-sheet passing area of an A4 portrait sheet (Step C4) by the movement of the shutter 44, the sheet supply is started (Step C5).

When the non-sheet passing area temperature exceeds 200° C. during the first job (Step C6), the air blowing fan 41 is turned on to blow cooling air onto the fixing belt 33 in the non-sheet passing area of an A4 portrait size (Step C7). When the non-sheet passing area temperature becomes lower than 190° C., the air blowing fan 41 is turned off (Step C9). The air blowing fan 41 is turned off for the purpose of preventing the fixing defects that are caused by the decrease in temperature of the sheet-passing area end when the non-sheet passing area surface temperature decreases excessively.

In the case where A4 landscape sheets are supplied as a second job after the completion of the first job, it is determined that the recording material has an A4 landscape size from the sent size of a copying mode (Steps C12 and C13). In the case where the recording material is larger than the recording material size in the previous job, when the non-sheet passing area temperature is equal to or lower than the large-size sheet passing possible temperature Thot (Step C14), large-size sheets are supplied immediately. However, in the case where the non-sheet passing area temperature is equal to or higher than the large-size passing possible temperature Thot, the air blowing fan 41 is turned on immediately, cooling air is blown onto the non-sheet passing area of an A4 portrait size of the fixing belt 33 to perform air blowing/cooling (Step C15). After the non-sheet passing area temperature reaches Tstart or lower (Step C16), the air blowing fan 41 is turned off (Step C17), and A4 landscape sheets are supplied. In the fixing apparatus of this embodiment, Thot is 190° C., at which hot-offset occurs, and Tstart is 165° C., at which the width-direction temperature of the fixing belt 11 becomes uniform.

Figure 17:
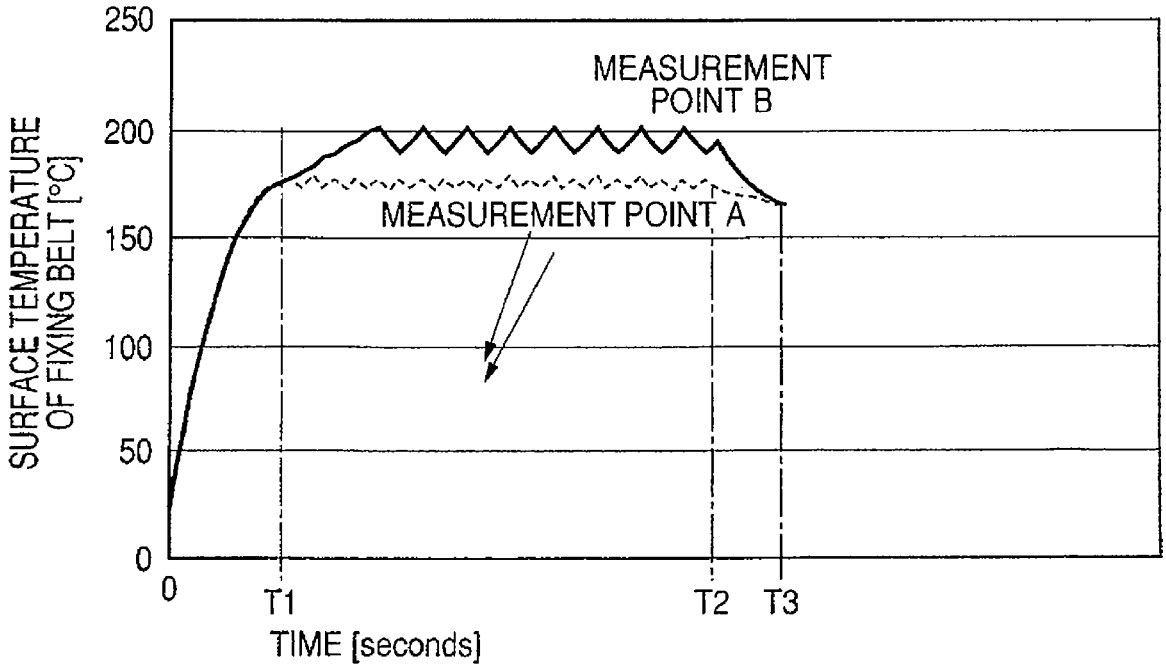
FIG. 17 is a view illustrating a temperature transition.

FIG. 17 shows specific temperature transition and time transition. As described above, in the fixing apparatus of this embodiment, the non-sheet passing temperature of the surface of the fixing belt 33 after the continuous supply of A4 landscape sheets is 190 to 200° C., which are higher than Thot, and lower by 10 to 20° C. compared with the case where air blowing/cooling is not performed during the sheet supply.

Thus, in the case where the pressure roller 32 and the fixing belt 33 are driven without energizing the heater 35, and the air blowing width is set to the non-sheet passing area of an A4 portrait sheet, and the fixing belt 33 is cooled with blowing cooling air, a time required for the temperature over the entire area in the width direction of the fixing belt 33 to be uniform becomes short. In this embodiment, the entire area in the width direction of the fixing belt 33 becomes uniform about 7 seconds (i.e., T2 to T3) after the completion of the supply of A4 portrait sheets.

After that, when the heater 35 is energized, and the surface temperature of the fixing belt 33 reaches about 175° C., the supply of A4 portrait sheets is started. In this case, the downtime is about 7 seconds. That is, by performing air blowing/cooling, the downtime can be shortened by about 38 seconds compared with the conventional fixing apparatus described in the first embodiment.

In this embodiment, the temperature at which the air blowing fan 41 is turned on/off during the continuous supply of small-size recording materials is set to be 200° C. However, it is needless to say that the temperature may be appropriately determined by a configuration of the fixing apparatus and the like.

Third Embodiment

In this embodiment, after the completion of the continuous small-size recording materials with the same width, a difference between the temperature detected by the temperature detection, means for detecting the temperature of the non-sheet passing area of the fixing mechanism portion 20A and the temperature detected by the temperature detection means for detecting the temperature of a sheet-passing area is equal to or higher than a predetermined temperature. In this case, the non-sheet passing portion is cooled without changing the length in the width direction of the air blowing port with the air blowing/cooling mechanism portion 20B.

Figure 18:
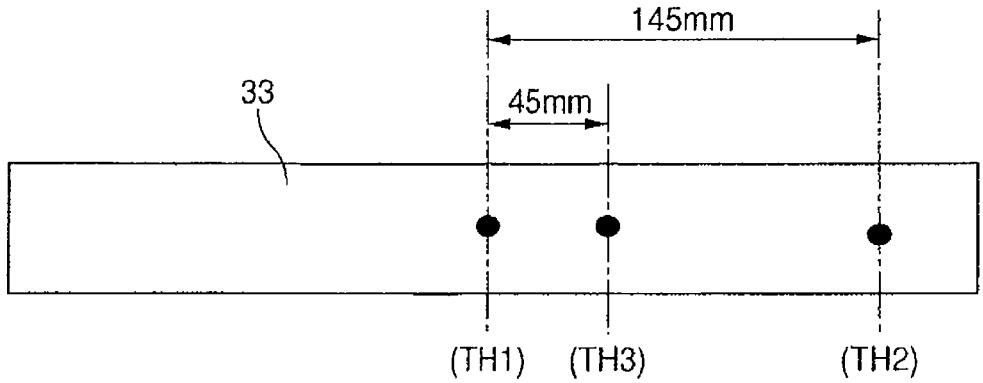
FIG. 18 is a view illustrating a temperature measurement position of a fixing belt surface in a third embodiment of the present invention.

In FIG. 18, reference symbol TH3 denotes a third temperature sensor such as a thermistor for detecting the temperature of the sheet-passing area of the fixing belt 33 after the completion of the continuous supply of small-size recording materials. The output thereof (i.e., signal value regarding temperature) is inputted to the control circuit portion 100 via an A/D converter. The third temperature sensor TH3 is provided elastically in contact with the inner surface of a base layer in a belt portion in the same way as in the second temperature sensor TH2, at a position away by 45 mm toward the second temperature sensor TH2 side from the center of the sheet passing area of the fixing belt 33. The temperature of the non-sheet passing area of the fixing belt 33 after the completion of the continuous supply of small-size recording materials is detected by the second temperature sensor TH2.

Figure 19:
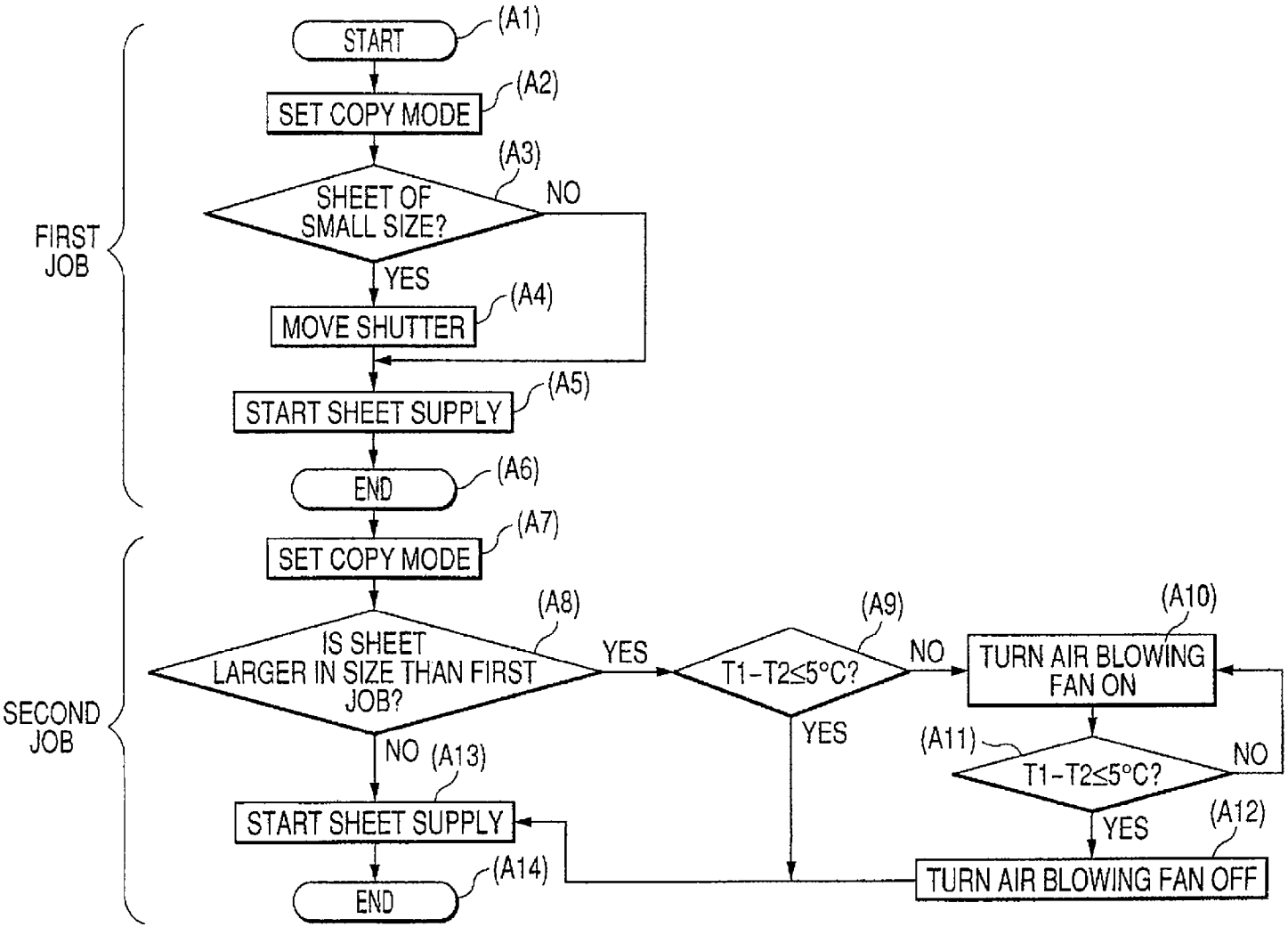
FIG. 19 is a flowchart illustrating a cooling method of the third embodiment of the present invention.

FIG. 19 is a control flowchart in this embodiment. Steps A1 to A8 are the same as those in the control flowchart in FIG. 1A in the first embodiment, so that the description thereof will be omitted.

In the case where A4 landscape sheets are supplied as a second job after the completion of the first job, the control circuit portion 100 determines that the recording material has an A4 landscape size from the set size of a copying mode (Steps A7 and A8). In the case where the recording material is larger than the recording material in the previous job, when a difference (i.e., T2−T3) of the temperatures detected by the second and third temperature sensors TH2 and TH3 is 5° C. or lower (Step A9), maximum-size sheets are supplied immediately. However, in the case where the difference exceeds 5° C., the air blowing fan 41 is turned on immediately, and cooling air is blown to the non-sheet passing area of an A4 portrait size of the fixing mechanism portion 20A to perform air blowing/cooling (Steps A10 and A11). After the difference (i.e., T2−T3) becomes 5° C. or lower, the air blowing fan 41 is turned off (Step A12), and A4 landscape sheets are supplied.

In order to prevent hot-offset in the case where large-size recording materials are supplied after the temperature of the non-sheet passing portion increases compared with the sheet-passing portion during the continuous supply of small-size recording materials, large-size recording materials may be supplied after the temperature in the longitudinal direction of the fixing belt 3 becomes uniform.

In the image heating apparatus of this embodiment, the temperatures of the non-sheet passing portion and the sheet passing portion of the fixing belt 3 are detected. Therefore, the temperature difference in the longitudinal direction of the fixing belt 3 can be detected with good precision, which makes it possible to further reduce the downtime.

Described are three embodiments of the present invention. However, the present invention is not limited to the above-mentioned configuration, and various configurations can be adopted in accordance with the proposal of the present invention.

In the above description, the fan 41 cools the fixing member. However, the same effects can be obtained even in the configuration in which the fan 41 cools the pressure member.

The heating rotary member is a thin-walled roller type member with a small heat capacity in the above description. However, the heating rotary member is not particularly limited thereto. The same effect can be obtained even with a belt type fixing member.

The fixing mechanism portion 20A is not limited to the film heating type heating apparatus described in the above embodiments, but can also be a heat roller type heating apparatus or heating apparatuses of other configurations. The fixing mechanism portion 20A may also be an electromagnetic induction heating type apparatus.

The same effect can be obtained even when the fixing mechanism portion 20A has a configuration in which the recording material is passed based on the one-sided transfer reference.

The fixing apparatus has been described above as an example of the image heating apparatus. However, the present invention is also applicable to a gloss improving apparatus for heating an image fixed onto the recording material to improve the gloss of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265880, filed Sep. 13, 2005, which is hereby incorporated by reference herein in its entirety.

What is claimed is:

1. An image heating apparatus comprising:

a heating rotary member, which heats an image on a recording material at a nip portion;

air blowing means for blowing air toward an air blowing port to cool a predetermined area of the heating rotary member;

a shutter, which opens and closes the air blowing port; and determination means for determining an execution of an operation of the air blowing means with the shutter opened after a first job is completed, in accordance with a size of a recording material in a width direction perpendicular to a recording material transport direction in a second job for supplying a recording material, between an execution termination of the first job for continuously supplying recording materials having a size smaller than a predetermined size in the width direction, while operating the air blowing means, and a start of a recording material supply of the second job, in a case that the second job is executed subsequent to the termination of the first job.

2. An image heating apparatus according to claim 1, wherein the shutter moves so as to adjust an opening width of the air blowing port in accordance with a length in the width direction of the recording material.

3. An image heating apparatus according to claim 2, wherein a cooling operation can be performed continuously with the shutter opened so that the opening width is maintained after image heating processing is completed.

4. An image heating apparatus according to claim 1, further comprising temperature detecting means for detecting a temperature of the predetermined area of the heating rotary member, wherein a cooling operation is performed continuously even after image heating processing is completed, in a case when a detected temperature of the heating rotary member when the image heating processing is completed is at least a predetermined temperature.

5. An image heating apparatus according to claim 4, wherein the cooling operation is stopped when the detected temperature of the heating rotary member decreases to the predetermined temperature.

6. An image heating apparatus according to claim 4, wherein the air blowing means is operated under a condition that the shutter is opened, in a case when the detected temperature of the heating rotary member reaches the predetermined temperature during the image heating processing.

7. An image heating apparatus according to claim 1, wherein the heating rotary member fixes an unfixed image onto the recording material.

8. An image heating apparatus according to claim 1, wherein the heating rotary member comprises an endless belt.

9. An image heating apparatus comprising:

a heating rotary member, which heats an image on a recording material at a nip portion;

air blowing means for blowing air toward an air blowing port to cool a predetermined area of the heating rotary member;

a shutter, which opens and closes the air blowing port; and determination means for determining an execution of an operation of the air blowing means with the shutter opened after a first job is completed, in accordance with a size of a recording material in a width direction perpendicular to a recording material transport direction in a second job for supplying a recording material, between an execution termination of the first job for continuously supplying recording materials having a size smaller than a predetermined size in the width direction, while operating the air blowing means, and a start of a recording material supply of the second job, in a case that the second job is executed subsequent to the termination of the first job, wherein the apparatus has a mode in which a cooling operation is performed continuously with the shutter opened after a last recording material has passed through the nip portion.

* * * * *